US011767788B2

(12) United States Patent
Thompson et al.

(10) Patent No.: US 11,767,788 B2
(45) Date of Patent: Sep. 26, 2023

(54) INDUCTION CLEANING USING ALTERNATE LAYERS OF A FIRST CHEMISTRY AND A SECOND CHEMISTRY

(71) Applicants: Bernie C. Thompson, Tijeras, NM (US); Neal R. Pederson, Los Alamos, NM (US)

(72) Inventors: Bernie C. Thompson, Tijeras, NM (US); Neal R. Pederson, Los Alamos, NM (US)

(73) Assignee: ATS Chemical, LLC, Albuquerque, NM (US)

( * ) Notice: Subject to any disclaimer, the term of this patent is extended or adjusted under 35 U.S.C. 154(b) by 461 days.

(21) Appl. No.: 16/913,491

(22) Filed: Jun. 26, 2020

(65) Prior Publication Data

US 2020/0340397 A1 Oct. 29, 2020

Related U.S. Application Data

(63) Continuation of application No. 16/227,509, filed on Dec. 20, 2018, now abandoned, which is a (Continued)

(51) Int. Cl.
*F02B 77/04* (2006.01)
*F02M 35/10* (2006.01)
(Continued)

(52) U.S. Cl.
CPC ..... *F02B 77/04* (2013.01); *F02M 35/10209* (2013.01); *C10L 10/06* (2013.01); *F02M 65/007* (2013.01)

(58) Field of Classification Search
None
See application file for complete search history.

(56) References Cited

U.S. PATENT DOCUMENTS

2003/0158061 A1* 8/2003 Ahmadi ..... C11D 11/0041 510/185
2007/0012342 A1* 1/2007 Stansilaw ..... F02M 43/00 134/169 A
2008/0060680 A1* 3/2008 Esterline ..... B08B 9/00 134/184

FOREIGN PATENT DOCUMENTS

WO WO-9309859 A1 * 5/1993 ..... B01D 11/0257

OTHER PUBLICATIONS

English Machine Translation of WO9309859A1.*

* cited by examiner

*Primary Examiner* — Nicole Blan
(74) *Attorney, Agent, or Firm* — DeWitt M. Morgan

(57) ABSTRACT

This invention relates to the field of induction cleaning, more particularly to chemically cleaning the induction system of the internal combustion engine. The carbon that accumulates within the induction tract of the internal combustion engine is very difficult to remove. Chemically these carbon deposits are very close to that of asphalt or bitumen. It has been found that if the induction cleaning chemicals are delivered in timed layered intervals the removal of such induction carbon can be accomplished. The Dual Solenoid Induction Cleaner uses electronically controlled solenoids to deliver at least two different chemistries in alternating layers to the engine's induction system. These electric solenoids are connected to a single induction cleaner nozzle. The induction cleaner nozzle is slipped through the vacuum port opening into the inside of the induction system where it will spray an aerosol of the chemistry directly into the moving air column entering the engine.

8 Claims, 22 Drawing Sheets

Related U.S. Application Data continuation of application No. 14/584,684, filed on Dec. 29, 2014.

(60) Provisional application No. 62/061,326, filed on Oct. 8, 2014.

(51) Int. Cl.
*F02M 65/00* (2006.01)
*C10L 10/06* (2006.01)

Dual Solenoid Induction Cleaner Program

The vehicle battery is connected to the induction cleaner
The power lamp D5 is illuminated showing unit is ready

Information:

- o Default = solenoid 1 driver Q2 and solenoid 2 driver Q5 are Locked Off
- o Not armed lamp Codes =
  - • If Air pressure <125psi, lamp D3 is pulsed 2 times then a 3 second pause
  - • If in operation Engine Running signal is <.79G, lamp is pulsed 3 times then a 3 second pause
  - • If in operation Vehicle Battery Voltage is <12.49, lamp D3 is pulsed 4 times then a 3 second pause
    - > Code will cycle until enabling criteria is corrected
    - > If more than 1 code is present at once, rotate codes
- o All time periods in program shall be where they can be adjusted

- Start Dual Solenoid induction Cleaner program
- If the arm/disarm button S1 is pushed
  - o If enabling criteria is (true) air pressure is >125 psi
    - • The system is armed
    - • The armed lamp D6 is activated
  - o If enabling criteria is (false) air pressure <125 psi
    - • The system is not armed
    - • The not armed lamp D3 is activated two times and then a 3 second pause, this is then cycled until the air pressure enabling criteria is correct
  - o If Else: Disarm system, set solenoids at default
- If crank button S2 is pushed/ and unit is armed
  - o If enabling criteria is (true) air pressure is >125 psi and vehicle battery voltage is >12.5V
    - • The onetime pre wash cleaner solenoid is activated, driver Q2 for 5 seconds and then shut off
    - • If crank button is pushed the not armed lamp D3 alert circuit is activated for 4 seconds, this will warn that starter will now be engage (rapidly pulse alert for crank warning)
    - • After 5 second period from start crank button being pushed, the starter is now activated, driver Q3 is turned on for 21 seconds and then shut off
    - • If enabling criteria for engine cranking is (true) >.8 G indicating engine is turning
    - • The cleaner solenoid is activated, driver Q2 for the 20 second crank period and is then shut off
    - • At end of 20 second crank period, activate soak time lamp D8, start timer for 15 minutes
    - • At end of soak time period deactivate soak time lamp D8
    - • At end of soak time period activate not armed lamp D3 until start clean button is pushed, crank button is pushed or arm/disarm button is pushed
      - > If enabling criteria for engine Cranking is (false) <.79 G after 2 seconds during crank period

Fig 20A

- The cleaner solenoid is deactivated, driver Q2 is shut off (default)
- The crank circuit Driver Q3 is shut off
- The not armed lamp D3 is activated three times and then a 3 second pause, this is then cycled for 15 seconds
- If start button is pushed again, cleaner solenoid onetime pre wash will not occur o If enabling criteria is (false) air pressure <125 psi or vehicle battery voltage <12.49V

- The cleaner solenoid is locked off (default)
- If air pressure is <125 psi the not armed lamp D3 is activated two times and then a 3 second pause, this is then cycled until enabling criteria is correct
- If the vehicle battery voltage is <12.49V the not armed lamp D3 is activated four times and then a 3 second pause, this is then cycled until enabling criteria is correct o If Else: Disarm system, set solenoids at default

- If start clean button S3 is pushed/ and unit is armed o If enabling criteria is (true) air pressure is >125 psi and engine running is >.8 G indicating engine is running

- (1) The cleaner solenoid is activated, driver Q2 is turned on for 30 seconds then is shut off
- (2) There is a 30 second period with driver Q2 and Q5 at default
- (3) The wash solenoid is activated, driver Q5 is turned on for 30 seconds then is shut off
- (4) There is a 30 second period with driver Q2 and Q5 at default
- Sequence 1-4 is cycled for 25 minutes
- If sequence 1-4 is cycled for 25 minutes, finished lamp D2 is activated until arm/disarm button is pushed disarming system > If enabling criteria is (false) during induction clean, air pressure is <125 psi or engine running is <.79 G indicating engine is not running

- Solenoids are put into default
- If air pressure is <125 psi, lamp D3 is pulsed 2 times then a 3 second pause, this is then cycled until enabling criteria is correct
- If Engine Running condition is <.79G, lamp D3 is pulsed 3 times then a 3 second pause, this is then cycled until enabling criteria is correct
- Time is calculated from Start Clean so that when enabling criteria is corrected, and Start Clean button is pushed to restart clean cycle, the cycle is started at point of default, so that 25 minute total is completed at end of Start Clean period o If enabling criteria is (false) air pressure is <125 psi or engine running is <.79 G indicating engine is not running

- Solenoids are put into default
- If air pressure is <125 psi, lamp D3 is pulsed 2 times then a 3 second pause, this is then cycled until enabling criteria is correct
- If Engine Running condition <.79G, lamp is pulsed 3 times then a 3 second pause, this is then cycled until enabling criteria is correct o If Else: Disarm system, set solenoids at default

Fig 20B

INDUCTION CLEANING USING ALTERNATE LAYERS OF A FIRST CHEMISTRY AND A SECOND CHEMISTRY

CLAIM OF PRIORITY

This application is a continuation of application Ser. No. 16/227,509 filed Dec. 20, 2018 which, in turn, is a continuation of application Ser. No. 14/584,684 filed Dec. 29, 2014 which, in turn, is a continuation-in-part of and claims the benefit of provisional application Ser. No. 62/061,326, filed Oct. 8, 2014. The priority of all these applications is claimed.

FIELD OF INVENTION

This invention relates to the field of induction cleaning, more particularly to chemically cleaning the induction system of the internal combustion engine. This method uses chemicals, typically different, delivered in stages in order to remove buildup of carbon accumulation from the induction system or intake track which can include the throttle body, throttle plate, intake plenum, intake manifold, intake charge valve, intake runners, intake opening or port, and intake valve. It has been found that if the induction cleaning chemicals are delivered in timed intervals (sometimes referred to as layers or layering) the removal of such induction carbon can be accomplished. A preferred embodiment uses electronically controlled solenoids to deliver at least two different chemistries in alternating layers to the engine's induction system.

BACKGROUND OF THE INVENTION

Even though the carbon compounds that accumulate in the engine are unwanted, carbon is very much a part of the internal combustion engine. This is due to the fact that lubricants and fuels used in the engine are carbon based compounds. The lubricant and fuel carbon bonds are formed with hydrogen and produce hydrocarbon chains. These hydrocarbon chains are refined from crude oil and contain various molecular weights. When these hydrocarbon chains are formed to produce lubricating oil they contain heavier, thicker petroleum based stock that have between 18 and 34 carbon atoms per molecule. Lubricating oil creates a separating film between the engine's moving parts that is used to minimize direct contact between the moving parts which decreases heat caused by friction and reduces wear, thus protecting the engine. When these hydrocarbon chains are made for fuel such as gasoline, they contain lighter petroleum based stock that have between 4 and 12 carbon atoms per molecule. Overall, a typical gasoline is predominantly a mixture of paraffins (alkanes), cycloalkanes (naphthenes), and olefins (alkenes). Fuel is blended to produce a rapid high energy release combustion event that propagates through the air in the combustion chamber at subsonic speeds and is driven by the transfer of heat. As the internal combustion engine is operated the fuel's energy is released in the combustion chamber. This occurs by a chemical change in the hydrocarbon chains. The heat from the ignition spark (gasoline) or from the compression (diesel) breaks the hydrocarbon chains so the bonds between the carbon and hydrogen are separated. This allows the carbon to bond with dioxygen (O2), and the hydrogen to bond with oxygen (O); thus changing the hydrocarbon chains to carbon dioxide (CO2), and water (H2O). However, if there is a lack of oxygen during the burning of the fuel then pyrolysis occurs.

Pyrolysis is a type of thermal decomposition that occurs in organic materials exposed to high temperatures. Pyrolysis of organic substances such as fuel produces gas and liquid products that leave a solid, carbon rich residue. Heavy pyrolysis leaves mostly carbon as a residue and is referred to as carbonization.

As this carbon buildup creates tailpipe emission problems, drivability problems, and poor fuel economy, it is desirable to remove this buildup from the internal combustion engine. This carbon can be removed by engine disassembly and manual cleaning, however this is very time consuming and expensive. An easier, less expensive alternative is to remove this carbon buildup using chemicals to clean the engine. Over the years there have been numerous attempts involving the use of cleaning apparatus and chemicals to solve the problem of carbon buildup removal.

In U.S. Pat. No. 4,671,230 Turnipseed discloses a device that holds or contains a mixture of carbon cleaning solution and gasoline. The vehicle's fuel supply system is disabled from the engine and the invention is connected to the fuel delivery for the engine. The invention then supplies the engine with the pressurized cleaning solution as the engine is run. This cleaning solution is then delivered through the engine injectors. The problem with this method is that the cleaning solution is only applied to the intake valve and the immediate intake port area around the intake valve. The rest of the induction system remains uncleaned. Additionally, if the engine is that of a direct injection design, no intake cleaning will take place at all.

In U.S. Pat. No. 4,989,561 Hein discloses a device that connects to the throttle body of the engine. The device or metering block has an adjustment to increase or decrease the air flow into the engine. This air flow adjustment will set the air rate into the engine, thus bypassing the throttle plate control. The metering block also holds an electronic automotive style fuel injector that will deliver the cleaning chemical. The vehicle fuel system is disabled by unplugging the fuel injectors or fuel pump. If the vehicle is equipped with a Mass Air Flow (MAF) sensor an additional tube must be connected from the metering block to the MAF sensor. The throttle is then depressed and the engine is started and run on the cleaner solution that is pressurized and delivered to the engine. Once the cleaning solvent has been delivered and all of the chemical has been used, a second chemical is then added and the engine is run until all of this chemical has been used.

The problems with this method are threefold. The first problem is the complication and time to install the invention. The second problem is the engine Revolutions Per Minute (RPM) cannot be varied above the adjustment point of the metering block adjustment. The ability to change the RPM, which in turn changes the energy of the air flowing into the engine, is important. Since the energy of the air flow is carrying the chemical it will be necessary to raise the RPM and have a rapid throttle opening or snap throttle of the engine. This increased air flow will help prevent the chemical from puddling within the intake manifold as well as carry additional chemical to the carbon sites. The third problem occurs if the engine is equipped with Drive-by-wire. Drive-by-wire systems were first installed on vehicles as early as 1989 and by 2003 is standard equipment for most U.S. based vehicles. This system is a safety critical system where the Engine Control Unit (ECU) controls and monitors the throttle plate position. If the throttle plate position does not match the air flow rate commanded into the engine by the ECU the system is put into a default position. There are many different defaults that can be command by the ECU in order to maintain the air rate in to the engine. One such default could cause the engine to shut down by cutting the fuel, spark and air to the engine. Another default is accomplished whereby the throttle plate position is no longer controlled by the ECU but will allow the throttle plate position to be slightly opened by the default spring which will only allow the engine to run at about 1800 RPM. Additionally the fuel and spark can be turned on and off in order to control the air rate and RPM of the engine, which will cause severe damage to the catalytic converter. In yet another default the Drive-by-wire system will force the throttle shut when the expected air rate cannot be obtained.

In U.S. Pat. No. 6,557,517 B2 Augustus discloses a device that applies cleaning chemical into the engine through the spark plug hole. A single chemical cleaner is installed in the invention's multiple reservoirs in the main cylindrical body. The spark plugs are removed from the engine and an adapter is installed into each of the spark plug holes that are connected with hoses to the main cylindrical body. The main cylindrical body also contains a metering valve system that allows the chemical to be delivered directly into the cylinder without the engine hydrolocking or liquid locking. The cleaning chemical is put into the cylinder in order to clean the piston compression rings. In order to clean the piston rings the starter motor is bumped. Bumping means the starter is engaged for a very short time to move the piston up or down several inches. This piston movement when repeated multiple times with chemical cleaner applied to the piston ring will clean the carbon from the piston and piston ring.

The problem with this method is twofold. The first problem is the amount of time and knowledge required to install such a complicated device. The second problem is the only carbon removal that is accomplished is in the combustion chamber. The induction system or intake tract which can include; the throttle body, throttle plate, intake plenum, intake manifold, intake charge valve, intake runners, intake port, and intake valve are not cleaned at all by the invention.

In U.S. Pat. No. 6,530,392 B2 Blatter discloses a device that applies cleaning chemical into the engine through the vacuum port. The base of the device holds a can of chemical cleaner and has a means to adjust the flow rate of the cleaner that can be observed through a sight glass. The base is connected to the nozzle with a tube. The nozzle has a hole drilled at a 90 degree angle that will bleed air from the atmosphere into the discharge. The nozzle is connected to the engine vacuum hose on the engine's intake system. The engine is then started and run where the low pressure created by the running engine pulls the cleaner into the intake tract. The cleaner can be adjusted by turning the adjustment screw while watching the flow through the sight glass. The entire can of chemical is delivered in one continuous application to try to clean the engine. As the cleaner is pulled through the discharge nozzle air from the atmosphere moves through the air bleed, located in the discharge nozzle, where it is mixed with the chemical cleaner. This air bleed breaks up the liquid cleaner into droplets as it is delivered into the intake tract.

The problem with this design and its method of use is the droplet size is not consistent as is illustrated in Applicant's FIG. 10. As the engine is running the droplet sizes are both small and large without being held constant; with the larger sizes moving slower than the smaller droplet sizes in the air flow, they tend to congeal together making much larger droplets. As the liquid is broken up into droplets by the air bleed, the air to cleaner ratio is constantly changing. This allows the creation of droplets that are too large to be transported by the air flow making it difficult for the chemical to reach the carbon sites on the intake runner top and sides as well as the intake port top and sides. Thus, only some carbon is cleaned and some remains. Additionally there is very little vacuum under cranking and snap throttle conditions, so no chemicals can be pulled from the reservoir and be delivered to the induction system under these conditions.

As can be seen the prior art has many limitations. These limitations pose significant problems when cleaning the induction system. What is needed is the means to quickly and easily remove the carbon from the internal combustion engine. The present invention accomplishes this.

Problems and Objects

The above described systems all have problems removing the carbon from the internal combustion engine's induction system in real world situations. For any chemical to be affective it must first be delivered to the carbon sites. To accomplish this air flowing into the engine is used. The energy of the moving air column will carry the chemical into the engine. The question is how effectively is the chemical being carried to the carbon sites?

In modern engine designs the intake tract often has a scroll style intake (e.g. U.S. Pat. No. 7,533,644, U.S. Pat. No. 4,741,294 A). The air entering through the throttle body may be at a lower point than the intake valve. Additionally the intake tract may scroll upward and then back down to the intake valve port area. The intake may also have a charge valve which isolates two different intake runner lengths, these different length runners help with cylinder charge or fill. When induction cleaning chemical droplets are in the air column and are moving around these intake bends the droplets tend to fall out of the air column to the intake system's floor. When this occurs the intake tract floor can be cleaned, however the intake tract top and sides are left with carbon deposits. With this intake tract design, it is necessary to have small droplets or a true aerosol delivered to the intake tract. Further, this aerosol or small droplets needs to be delivered directly into the moving air column after the throttle plate. If the aerosol hits an obstruction such as the throttle plate or throttle body, or if the delivery system makes varying droplet sizes (e.g., Blatter), then the droplets will congeal into larger heavier droplets. These heavier droplets are unable to be supported by the energy of the moving air column and tend to fall out to the induction system's floor.

Furthermore, the carbon compounds within the internal combustion engine can vary in chemical composition and thickness making it very difficult to remove. The carbon from a running engine can be produced from the fuel or from the motor oil. Since both the fuel and motor oil are hydrocarbon based they can produce carbon compounds that can accumulate. Additionally if the engine is equipped with an Exhaust Gas Recirculation (EGR) system the burned hydrocarbons contained in exhaust gases can also accumulate in the induction system. The different types of carbon compounds and the amount of carbon accumulation within an engine will vary depending on several different variables such as the type of hydrocarbons the fuel is made of, the detergents added to the fuel base, the type of hydrocarbons the motor oil is made of, the operating temperature of the engine, the pressure the carbon is produced under, the load on the engine, the engine drive time, the engine drive cycle, and the engine design. Each of these variables will affect the type of carbon that will be produced and the carbon accumulation that will accrue within the engine.

It is important to understand that the carbon produced within an engine is not all the same. The carbon in the combustion chamber is produced under high heat and high pressure, creating a carbon that is denser and has low porosity. Additionally the carbon thickness is usually low. These combustion chamber deposits will cause high tailpipe emissions and pre-ignition problems which can cause serious engine damage. The carbon that is produced within the induction system is created under very different conditions than the combustion chamber deposits.

The carbon in the intake is produced under low heat and low pressure, creating a carbon that has high porosity. Additionally the carbon thickness can be quite high. The intake carbon accumulation can be produced in different areas such as the throttle body, intake plenum, intake runner, intake port, and the intake valve. These carbon deposits can disrupt the air flow into the cylinder causing performance and drivability issues. The more uneven the carbon accumulations are, the greater the air disruptions will be. These uneven intake carbon accumulations decrease power, torque, and fuel economy. With heavy intake carbon accumulations misfire conditions can also occur. This can be caused by major air disruptions or carbon creating valve sealing issues. Additionally the intake carbon deposits can create cold drivability issues; the intake carbon being very porous allows the fuel to be absorbed into the carbon creating a cold lean run condition.

The carbon that has accumulated within the induction system of the engine is very difficult to remove. Chemically these carbon deposits are very close to that of asphalt or bitumen. In order to break these carbon bonds down and remove them from the induction system it will require not only the use of chemicals capable of removing such carbon buildup, but the use of the layering technique of the present invention. This chemical layering technique can remove different carbon compound types and carbon thicknesses from the internal combustion engine.

What is needed is a method and apparatus that can quickly and accurately clean the induction system of the internal combustion engine regardless of the engine design or the amount of carbon buildup within the engine. The present invention accomplishes these goals.

SUMMARY OF THE INVENTION

The present invention relates to both apparatus and methods of applying chemicals to the induction system in stages in order for the removal of carbon buildup in the internal combustion engine. The method of removing carbon build up from the internal combustion engine includes, typically, the use of first and second different chemical compositions of matter (a "first chemistry" and "second chemistry") each capable of removing at least some carbon in at least a portion of the engine, and apparatus for delivering the first and second chemistries to the induction system in a series of stages. The method includes:

- running the engine;
- applying the first chemistry to the induction system for a first period of time (a stage);
- applying the second chemistry to the induction system for a second period of time (a second stage; the first and second stages constituting a cycle); and
- repeating the cycle at least once.

Typically, the method includes the step of including a time period (a pause stage) between the first and second stages wherein neither the first nor the second chemistry is being applied to the induction system to thereby permit at least one of the group including the first chemistry and the second chemistry to at least partially soak the carbon buildup in the induction system; the first, second and pause stages constituting the cycle. Alternately, the application of the second chemistry directly follows the application of the first chemistry. An additional alternative is to have the application of the second chemistry overlap the application of the first chemistry. While two different chemistries are typically used, the application of the chemistries in multiple stages can be affected with just one chemistry. And, in conjunction with this layering process, three or more different chemistries can be used.

A preferred apparatus includes a base assembly, microprocessor, control buttons, multiple reservoirs, air pressure regulator, pressure gauge, electronic controlled solenoids, delivery hoses, and an induction cleaner nozzle. The reservoirs are filled with two different chemical formulations or compositions of matter; a first chemistry and a second chemistry. An air pressure hose is connected to a pressure regulator that is connected to the base assembly to pressurize the chemistries contained in the reservoirs. These reservoirs are connected with delivery hoses to two electric solenoids. These two solenoids, or electric valves, are connected to a single induction cleaner nozzle. The induction cleaner nozzle is connected to an intake opening or port (e.g., vacuum port) on the engine intake tract. This nozzle is slipped through the port into the inside of the intake tract where it will sequentially spray small droplets (e.g., an aerosol) of each of the two chemistries. The solenoids are turned on and off in order to deliver the pressurized cleaning chemistries through the induction cleaner nozzle to the engine's induction system.

In such a preferred embodiment the solenoids are controlled by a microprocessor that has been programmed to deliver the chemistries to the induction system in 4 stages:

- Stage 1: A first chemistry is applied for 30 seconds and is then shut off.
- Stage 2: A period of 30 seconds where no chemistry is applied.
- Stage 3: A second chemistry is applied for 30 seconds and is then shut off.
- Stage 4: A period of 30 seconds where no chemistry is applied.

The foregoing timed interval sequences, or stages, are repeated for a period of, for instance, 25 minutes. The time period for each stage may be referred to as a run time. These run times can be varied depending on, for instance, the chemistries used. For example with different chemistries, the first stage could have a first run time of 5 seconds of chemistry being applied, followed by a 15 second pause time, and the second stage could have a second run time of 15 seconds of chemistry being applied, followed by a 30 second pause time. These stages would then be cycled, for instance, for 30 minutes.

In some circumstances the amount of chemistry being applied while the solenoid is on maybe increased by over 100% above the conventional amount of such chemistry that, based on the manufacturer's recommendation, would normally be applied. A conventional amount of chemistry delivery is about 16 oz. in 20 minutes at a constant delivery rate, which equates to 0.8 oz. of chemical per minute. In a preferred embodiment the Dual Solenoid Induction Cleaner delivers 32 oz. of such chemistry in 12½ minutes, which equates to 2.56 oz. of chemical per minute. With this additional chemistry being delivered to the engine it becomes necessary to periodically stop the delivery. Without the above referenced 30 second pause the engine's catalytic converter, and/or the turbo charger, would overheat and become damaged. However, with this pause the catalytic converter, and/or the turbo charger, temperature can be maintained, thus protecting them from damage.

Additionally during the pause the chemistry has time to soak the carbon sites which helps with its removal. This pause stage could be carried out between just the first and second stage or just between the second and first stage. However, testing with the pause stage, and testing without the pause stage, clearly indicated that the chemistries worked better with a pause between each of the chemistry stages. Additionally through testing it has been determined that even if only one chemistry is used the pause stage allows the induction system to be cleaned far better than without the pause stage. This is due to the increased amount of time that the chemical is in contact with the carbon without saturating the carbon deposit. In some cases using some chemistries the carbon deposit will become gummy when saturated making the carbon deposit difficult to remove. With the traditional method of chemistry delivery the chemistry is continuously delivered into the induction system therefore keeping the carbon deposit saturated. However, with the chemistry delivery being paused the carbon does not become saturated. Thus, the chemistry can work far better at removing the carbon deposits from the induction system. Further, with the increased volume of chemistry being applied to the induction system there is actually enough to wash out or remove the carbon deposits. One of the real advantages of using two different chemistries is that the first chemistry will break down a small amount of the carbon surface and the second chemistry will remove or wash this small amount of carbon out of the engine. Thus, in the description of the apparatus in the preferred embodiment, the first chemistry may be referred to as cleaner and the second chemistry may be referred to as wash. By removing small amounts at a time the carbon can actually be removed on a repeatable base from the internal combustion engine. It should be appreciated that with different chemistries one may be formulated (or act more effectively) to remove, flush, or wash out the immediately preceding chemistry and carbon which has been previously loosened. It should also be appreciated that, after the application of the first chemistry for the first time, each following application of chemistry (whether the same chemistry or different chemistry) will have some washing effect.

If a lower weight of chemistry were delivered, such as the conventional amount normally used, the pause where no chemical is delivered between alternating applications of chemistry would not have to be carried out (however as described above the pause helps with the carbon deposit breakdown and removal). Since the chemical weight is much less the catalytic converter and/or the turbocharger temperature will not increase to a point of damage. However, with or without the pause, the alternating layering of the different chemistries will provide superior carbon removal.

It is important to understand that with conventional methods of chemistry delivery the engine is running while chemistry is delivered continuously (in bulk) to the engine. One example of this is if two different chemicals were going to be used and each chemical was 16 ounces, the entire 16 oz of the first chemical would be continuously delivered and then the entire 16 oz of second chemical would be continuously delivered. This conventional method of bulk delivery is not that of the repeated alternate stages (i.e., cycling) of the present invention and, thus, will exhibit problems with carbon removal.

BRIEF DESCRIPTION OF THE DRAWINGS

FIGS. 20A and B show the Dual Solenoid Induction Cleaner program.

DESCRIPTION OF THE PREFERRED EMBODIMENT

Figure 1:
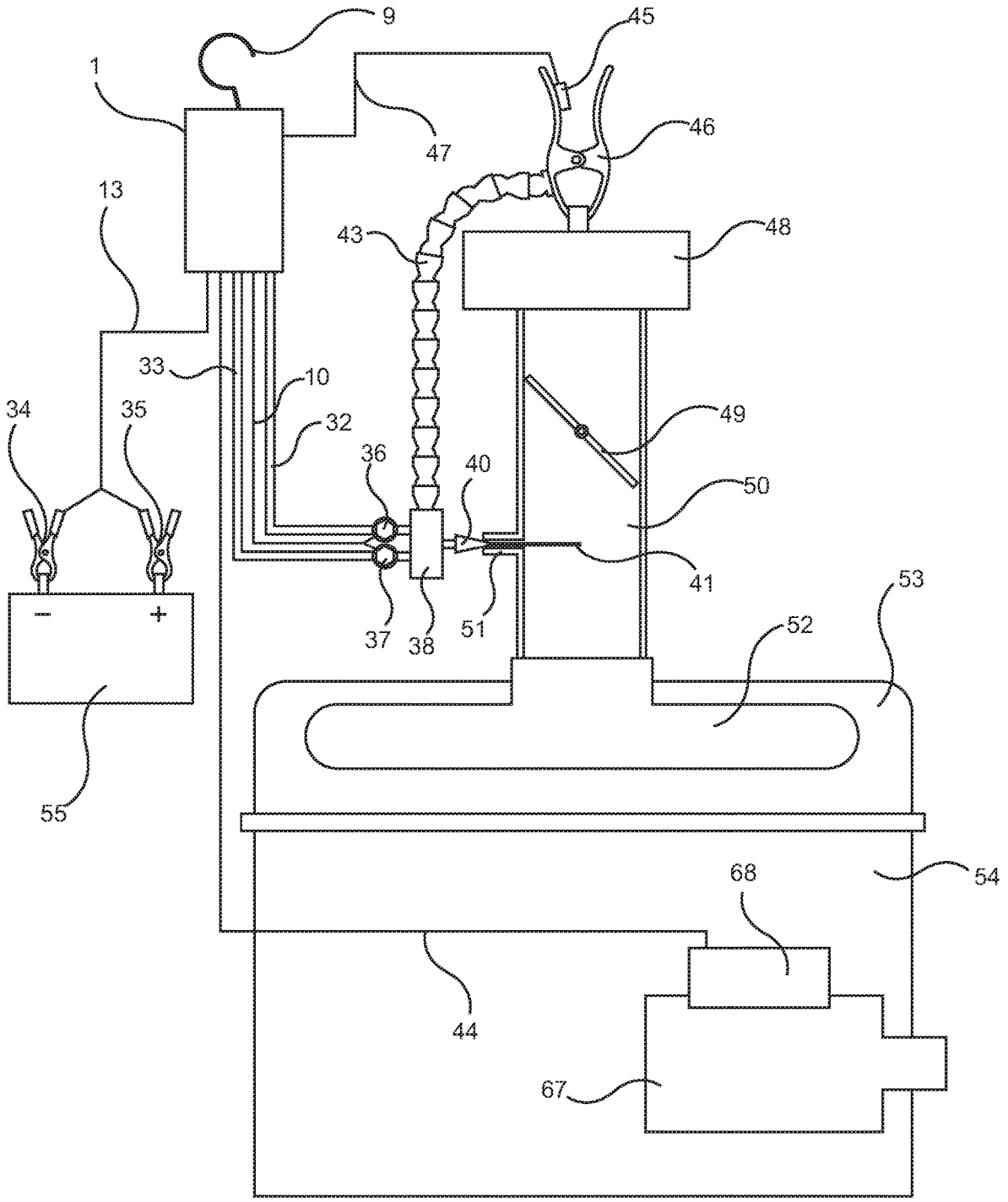
FIG. 1 illustrates the block drawing of the induction cleaner of the present invention connected to an engine.

FIG. 1 illustrates the Dual Solenoid Induction Cleaner 1 working in conjunction with an internal combustion engine 54. Internal combustion engine 54 has the cylinder head 53, intake manifold 52, throttle body 50, throttle plate 49, intake opening or port (a/k/a vacuum port) 51, air filter 48, starter 67 and starter solenoid 68. Dual Solenoid Induction Cleaner 1 includes: a hook 9 to hang unit from vehicle hood; power lead 13, which supplies current to Dual Solenoid Induction Cleaner 1, is connected to vehicle battery 55 with negative clamp 34 and positive clamp 35; induction cleaner supply lines 32 and 33 connect Dual Solenoid Induction Cleaner 1 to electric solenoids 36 and 37; electric solenoids 36 and 37 supply induction cleaner to induction cleaner nozzle 41 which is placed inside induction tract through vacuum port 51 opening. In operation engine run sensor 45 (discussed in detail below) sends signal to Dual Solenoid Induction Cleaner 1 through wire 47. Once engine run signal is received Dual Solenoid Induction Cleaner 1 can discharge chemistry.

Figure 2:
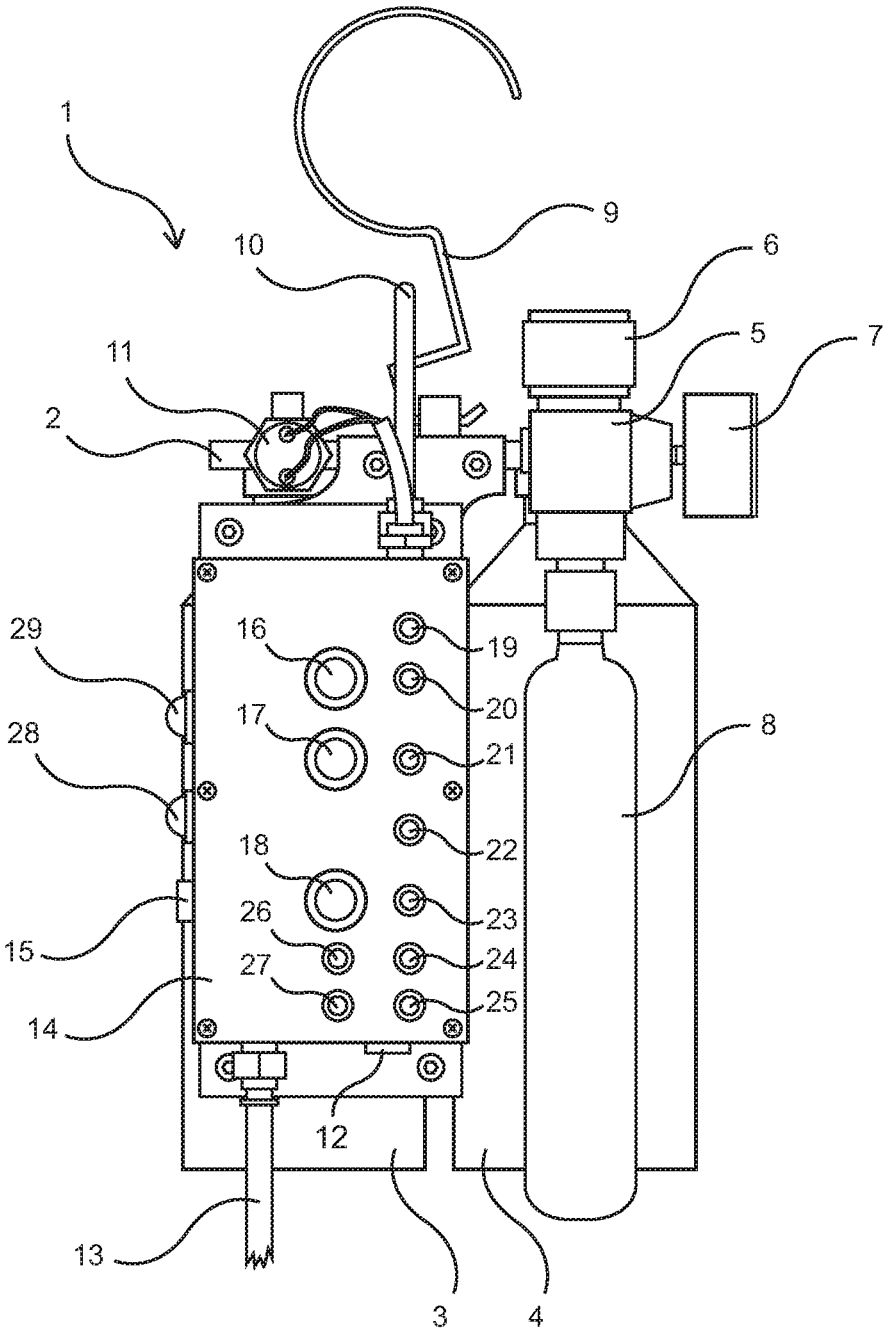
FIG. 2 illustrates the drawing of the induction cleaner from the front.

FIG. 2 shows the front view of control panel of Dual Solenoid Induction Cleaner 1. When vehicle battery (shown in FIG. 1) is connected through power lead 13 and external fuse 12 power lamp 19 is illuminated. This lets the service person know that the unit is powered and ready. To start induction cleaning, the service person will push arm/disarm button 16 in order to arm the system. If enabling criteria is present, which is that the air pressure supply level is good, the system can be armed. (The air pressure and air pressure switch can be adjusted so as to set the pressure needed for the particular chemistry being delivered.) If the enabling criteria is not present not armed lamp 28 is illuminated and audio alert (not shown) is beeped. Once the system is armed lamp 20 is illuminated. This lets service person know that the system can now discharge induction cleaning chemical.

It has been found that a chemical presoak will help remove the carbon buildup within the induction system. As with all induction cleaning chemicals, time is needed in order to break down carbon bonds. We have determined through testing that, when using some induction cleaning chemistry, if the induction cleaning chemistry is applied during an engine crank and then left to soak over time, the chemistry will start to break down the carbon bonds. The cranking time preferred is 20 seconds. This crank time is set due to the heat generated within the starter motor during long crank times. During engine cranking the engine slowly and evenly draws air into each cylinder. When the chemical is discharged during this crank period an even distribution of the chemistry can be applied within the engine. This cranking treatment will apply chemistry to the engine which includes, the intake tract (including the intake valve), combustion chamber, and exhaust valve. Once this chemical is applied and allowed to soak the chemistry starts breakdown or changing of the carbon bonds. While this soak time will vary depending on the specific chemistry used, testing has determined that a minimum of 15 minutes is necessary to start carbon breakdown with the presently available commercial carbon cleaning chemistries. After the soak period is completed it becomes much easier to remove the carbon during the engine run cleaning procedure.

If a chemical presoak is desired, wire 44 (shown in FIG. 1) is connected from banana plug connector 15 (shown in FIG. 5) to starter solenoid 68 (shown in FIG. 1) or starter relay (not shown). The enabling criteria for crank sequence is that the air pressure level is good, vehicle battery voltage is good, and the signal is received from engine run sensor 45 indicating the engine is cranking. The Dual Solenoid Induction Cleaner has multiple alert lamps to convey information to the service person on the current operating condition of the unit. If the enabling criteria are not present, the not armed lamp 28 is illuminated and audio alert (not shown) is beeped. If enabling criteria is good when the service person pushes crank button 17 a signal of 12 volts is supplied to starter solenoid 68 (shown in FIG. 1) or starter relay (not shown) for a preferred 20 seconds. This 12 volt power output will engage the starter thus rotating the engine over or turning the engine over. At this time the crank lamp 21 is illuminated and cleaner solenoid 36 (shown in FIG. 1) is turned on, lamp 26 is turned off and lamp 24 is turned on indicating that solenoid 36 is activated. This will supply induction cleaning chemistry to nozzle 41 (shown in FIG. 1) thus supplying it into the engine as it is cranked over for the 20 second crank period. At the end of crank period cleaner solenoid 36 is turned off as well as lamp 24, and lamp 26 is turned on indicating that solenoid is off. Additionally crank lamp 21 is turned off. Once the crank period is done, soak time lamp 22 is illuminated for a preferred 15 minutes. At the end of the 15 minute soak period the soak lamp 22 is turned off and audio alert (not shown) is beeped to let the service person know the soak period is done. If the service person wants to run additional presoaks the crank button 17 is pushed and the crank sequence is run over again.

The engine is now started and the service person will push the start clean button 18. The enabling criterion for the start clean sequence is the air pressure level is good and a signal is received from engine run sensor 45, indicating the engine is running. If the enabling criteria is not present not armed lamp 28 is illuminated and audio alert (not shown) is beeped. If enabling criteria is good the system will start to deliver induction cleaner for, for instance, 30 seconds. When the cleaner solenoid 36 (shown in FIG. 1) is turned on lamp 26 is turned off and lamp 24 is turned on, indicating the solenoid 36 is activated. At the end of this 30 second period the cleaner solenoid 36 is shut off and a non injection period is started. This non injection period is run for, again for instance, 30 seconds. When the cleaner solenoid 36 is turned off lamp 24 is turned off and lamp 26 is turned on, indicating the solenoid is off. At the end of this 30 second period solenoid 37 (shown in FIG. 1) is turned on for, for instance, 30 seconds. When solenoid 37 is turned on lamp 27 is turned off and lamp 25 is turned on, indicating the solenoid 37 is activated. At the end of the 30 second period solenoid 37 is turned off and a non injection period is started. Again, this non injection period is run for 30 seconds. When solenoid 37 is turned off lamp 25 is turned off and lamp 27 is turned on, indicating the solenoid 37 is off. This clean sequence is run over and over for a period of, for instance, 25 minutes. At the end of the 25 minute clean time the finished lamp 29 is illuminated and audio alert (not shown) is beeped to let service person know that the clean time has been completed.

It is important to understand that these time stage sequences can be altered for different chemistries. Different chemistries will need different time sequences in order to allow them to work to their maximum capability. Also the amount of chemical weight delivered to the engine can be changed for different chemistries in order to allow them to work to their maximum capability. Additionally more than two chemistries could also be used. During the testing of the Dual Solenoid Cleaner up to four different chemistries have been used. This required four different reservoirs in order to deliver the four different chemistries to the engine. Through testing it was determined that the use of what is sometimes referred to as first chemical cleaner and a second chemical wash provided the best results. These chemistries, called first chemical cleaner and second chemical wash, are just different chemistries that interact with one another quite well. These chemistries are chosen by the results of the interaction between the carbon and the chemistries themselves. Regardless of how much is delivered, the interaction of the chemistry with the carbon is important. If a large amount of a particular chemistry was used that did not work no carbon would be removed. Thus, the formulation of the chemistries used cannot be ignored.

The chemical nature of carbonaceous engine deposits varies somewhat depending on their location in the engine, which is largely a factor of deposition history, (e.g., temperature, combustion, amount of re-exposure to liquid). Although the deposits typically consist primarily of polynuclear aromatic hydrocarbon species, there are also aliphatic species that may be alkanes or alkenes and have varying degrees of oxygenation. The nature of the hydrocarbon mixture will depend, again, on the deposit location and deposition history. It is known that different solvent types, concentrations and combinations attack the various hydrocarbon types to varying degrees and that, furthermore, the efficacy of their effect is also a function of temperature, pressure, and exposure time. The latter is of particular importance when considering the Dual Solenoid Induction Cleaner run profile (discussed below) as well as knowledge of the specific chemical action performed on the various deposits by the various chemistries used.

In general, there are three types of carbon deposit cleaning solvents. (1) Non-Specific Solvents that remove the relatively small amount of waxy and resinous parts of the deposits based solely on solubility parameter interaction. These types of deposit materials typically occur in cooler areas of the engine, such as at the injector tip, and their removal can create larger pore volume in the remainder of the deposit that may be swelled by other, more aggressive solvents. Examples of non-specific solvents include acetone, alcohols, and ethers. (2) Specific Solvents that cause physical dissolution via electron density mediated disruption of non-covalent bonds. These solvents induce deposit swelling and will remove some fraction (approximately 20-40%) of the deposit that is chemically indistinguishable from the remainder of the deposit. Specific Solvents are typically molecules that contain a nitrogen atom and an oxygen atom with an unshared electron lone pair. Pyridine is an example of a Specific Solvent. (3) Reactive Solvents that cause deposit degradation by covalent bond cleavage. The chemical structure of both the solvent and the deposit may be altered as a result of the interaction. Reactive Solvents for carbon removal are generally either alkaline hydrolysis compounds/mixtures or dipolar aprotic 'super solvents'. An example of a super solvent is methyl pyrrolidones such as NMP.

It is important to know the nature of the chemistry that will be used so the microprocessor 96 (described below in conjunction with FIGS. 19 and 20) can be programmed for the run profile for the specific chemistry that will be used. This ability to program the Dual Solenoid Induction Cleaner to the chemistry/chemistries that are to be utilized is important in a number of different applications. The time the solenoids are turned on applying chemistry to the induction tract can be changed along with the time the solenoids are turned off. These on-off periods will change the way the chemicals will work. Once the chemistry is applied to the induction tract the chemistry off time will allow such chemistry the needed soak time in order to break the carbon bonds. (And, as discussed above, with this soak time pause the catalytic converter temperature and/or turbocharger temperature can be maintained, thus protecting it from damage.) This will allow the chemicals to work to their maximum capability. These carbon deposits are extremely difficult to remove and every advantage is needed in order to remove them from the internal combustion engine.

During testing of the Dual Solenoid Induction Cleaner the chemistries were layered, changed or alternated between different chemistries, and different time sequences determined using manual shut off valves and a stop watch. The engines being tested were checked with a borescope before any induction cleaning was done. Then the engines were cleaned with different chemistries and different timed sequences. After each of the cleaning processes the engines were re-inspected with the borescope. The result of how much carbon was removed from the engine with each of the chemistries and time sequences was then taken as data. This data was then used to design the Dual Solenoid Induction Cleaner. The manual shut off valves and a stop watch provided a quicker way to collect data from engines that had been cleaned. This data was then analyzed and the Dual Induction Cleaner run profiles, where the "first run time", and the "second run time", the "pause time", and the number of cycles (or the cycle time) were then programmed. Additionally, run profiles can be programmed where only a single chemistry is to be used. All such run profiles can be stored in the microprocessor. However, if the Dual Induction Cleaner is set up to run only certain, preselected chemistries, microprocessor 96 need only store the run profiles that can be used for such preselected chemistries. The use of manual shut off valves and a stop watch also demonstrates that these timed stage sequences can be accomplished manually, without a microprocessor or other electronic controls. Thus, anyone versed in the art could manually control these chemical delivery sequences to accomplish the same results.

Figure 3:
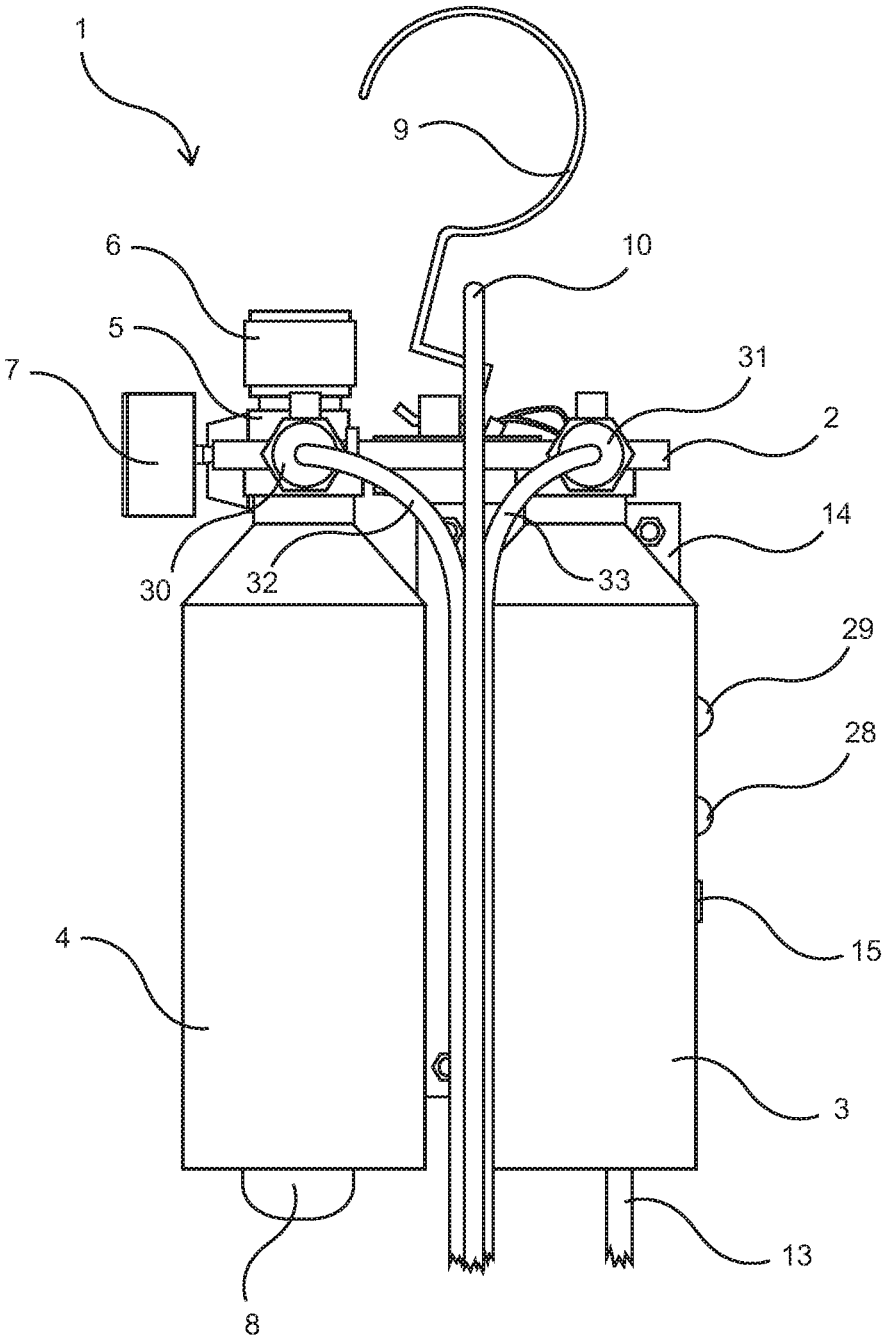
FIG. 3 illustrates the drawing of the induction cleaner from the back.

FIG. 3 shows the back view of the Dual Solenoid Induction Cleaner 1. The base 2 holds the chemical cleaner reservoir 4 and chemical wash reservoir 3. The cleaner supply line 32 is connected to base 2 with a manual shut off valve 30 and is isolated from wash supply line 33 which is connected to base 2 with a manual shut off valve 31. Control wire harness 10 runs from microprocessor (not shown but is held in housing 14) to injector solenoids 36 and 37 shown in FIGS. 6-7. Additionally, harness 10 carries wires for engine run sensor 45 (shown in FIG. 1).

Figure 4:
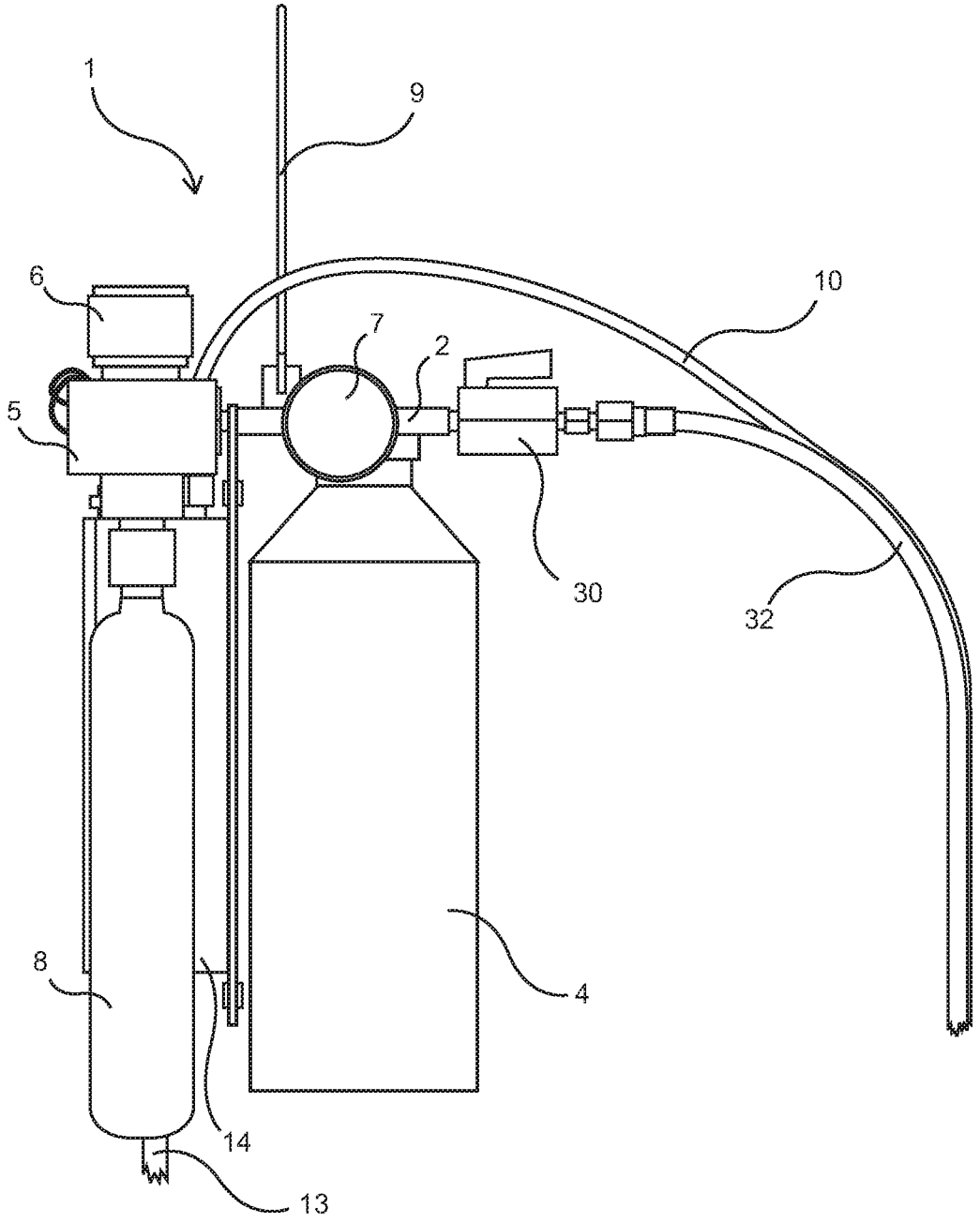
FIG. 4 illustrates the drawing of the induction cleaner from the right side.

FIG. 4 shows the right side view of the Dual Solenoid Induction Cleaner 1. The air pressure supply can be of two different types. If the vehicle is being cleaned where there is no compressed air available a 90 gram CO2 cartridge 8 is used. Alternately, if compressed air is available an air hose (not shown) from an external air compressor is used. This air pressure is fed into air pressure regulator 5, which is connected to base 2 and supplies pressurized air for the operation of the Dual Solenoid Induction Cleaner. Air pressure regulator 5 is adjusted with adjustment knob 6. As the air pressure regulator 5 is adjusted pressure gauge 7 connected to base 2 will show the actual air pressure within reservoirs 3 and 4.

Figure 5:
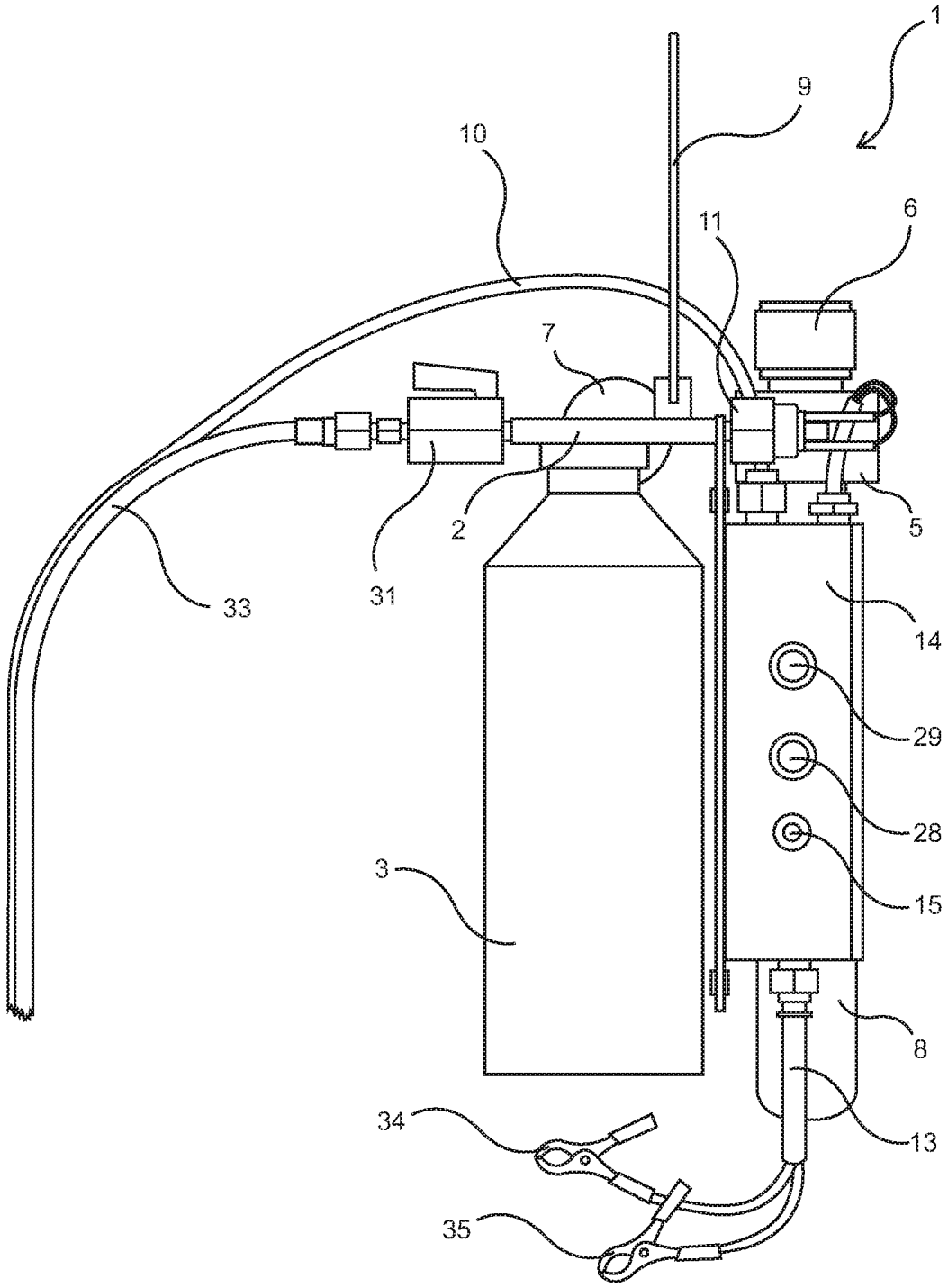
FIG. 5 illustrates the drawing of the induction cleaner from the from left side.

FIG. 5 shows left side view of the Dual Solenoid Induction Cleaner 1. Adjustable air pressure sensor 11 sends signal to microprocessor (not shown) but located in housing 14. Banana jack 15 supplies an output of 12 volts to starter solenoid 68 (shown in FIG. 1) or start relay (not shown). Not armed lamp 28 is turned on when enabling criteria is not correct. Not armed lamp 28 will pulse a code to let the service person know which of the enabling criteria is not present. Two pulses indicate that the air pressure is less than the set value; three pulses indicates that the run sensor signal is incorrect; and four pulses indicates the vehicle battery voltage is low. Finished lamp 29 is turned on when induction cleaning cycle is finished. Power harness 13 is connected to vehicle battery 55 (shown in FIG. 1) with negative clamp 34 and positive clamp 35. Power from harness 13 is feed through removable fuse 12 (shown in FIG. 2).

Figure 6:
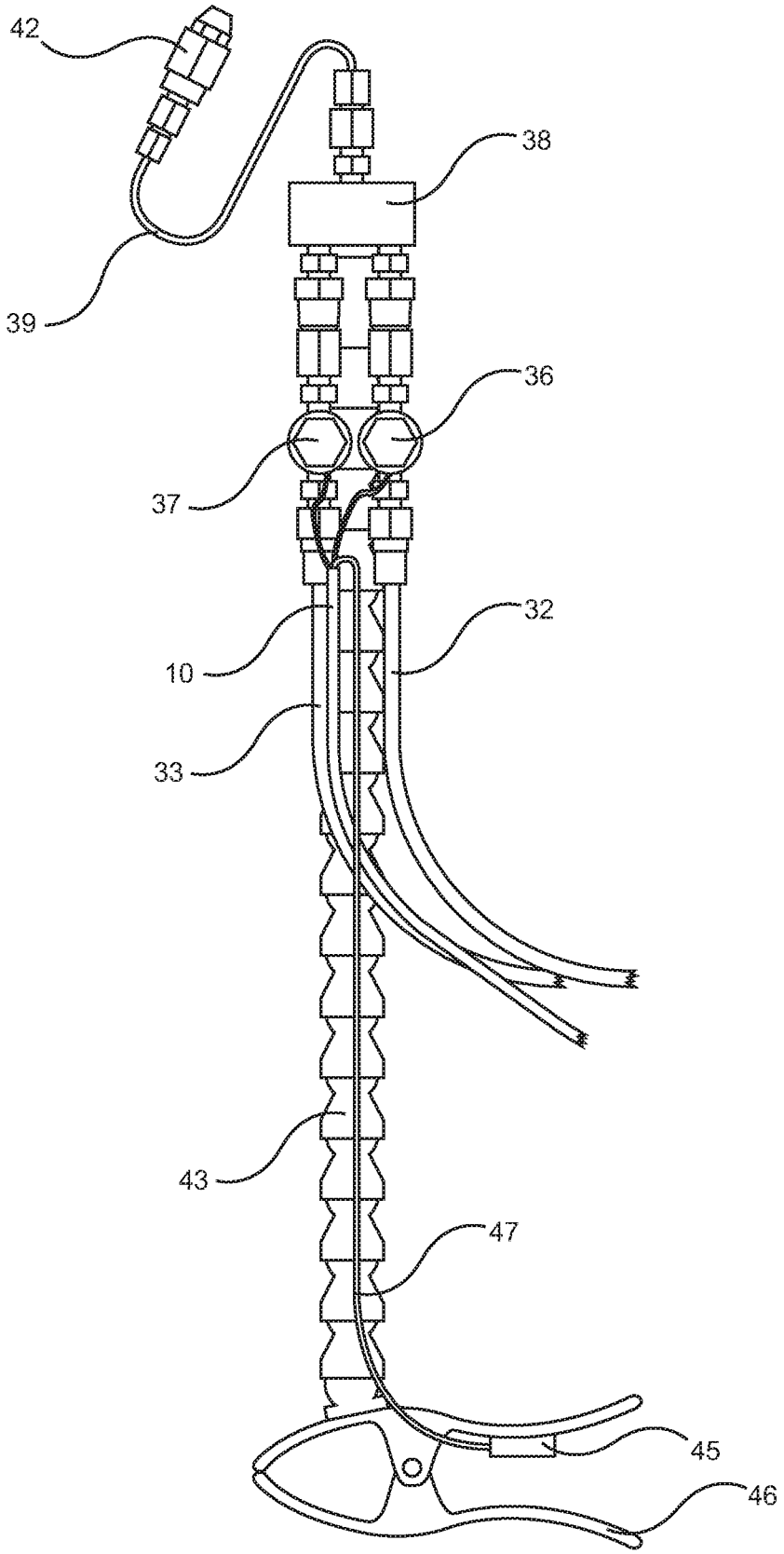
FIG. 6 illustrates the drawing of the induction cleaner with a conventional oil burner nozzle.
Figure 7:
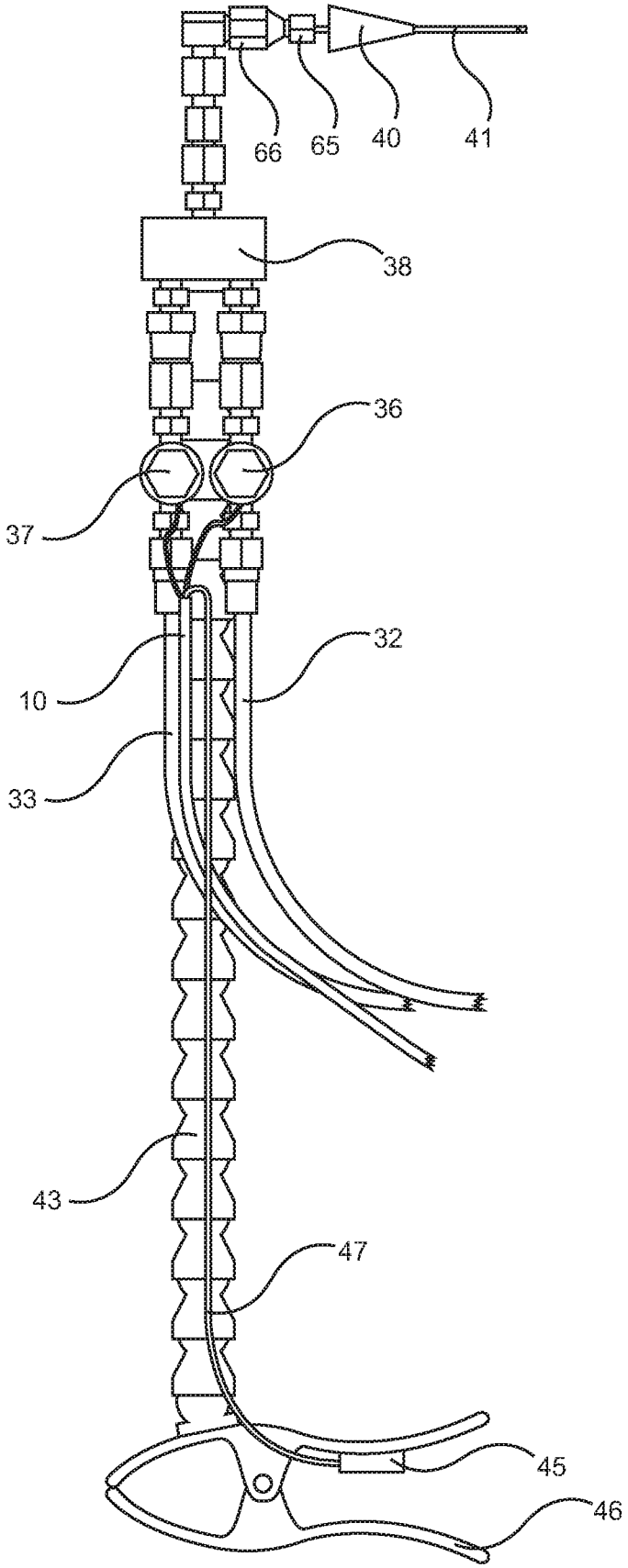
FIG. 7 illustrates the drawing of the induction cleaner with the unique induction cleaner nozzle of the present invention.

FIGS. 6-7 shows solenoid 36 and solenoid 37. These solenoids control the induction cleaning chemistries that are supplied through cleaner block 38 and tube 39 to conventional fuel oil burner nozzle 42, or through cleaner block 38 to novel induction cleaner nozzle 41 (discussed below in conjunction with FIGS. 12-16B). Cleaner block is supported by flex support tube 43 that is clamped to engine by clamp 46. When clamp 46 is locked to engine 54, engine run sensor 45 picks up vibrations from the engine. The engine run sensor is a conventional accelerometer which sends a signal to the microprocessor that the microprocessor (96 in FIG.

19) utilizes to interpret the engine running state condition. This sensor reads the vibrations produced when the starter motor is cranking the engine over and when fuel is ignited in the running engine. The accelerometer senses the engine running condition which is: engine off, engine cranking, and engine running. If the correct signal is not received by the microprocessor from the engine run sensor, the microprocessor will lock out solenoids 36 and 37. With these solenoids locked out chemistry will not be delivered to the engine.

In the past the ignition discharge was used for determining if the engine was running. However on modern vehicles it is extremely difficult to connect to the ignition system on the vehicle. Thus, the novel method described herein was developed. After testing different methods and using different sensors in order to determine if the engine is running, the accelerometer was found to provide the best results for this application. However, many other types of sensors which read the vibrations, oscillations or air pressure pulses from the engine (such as a microphone, tailpipe pressure transducer, crankcase pressure transducer, or induction pressure transducer) could also be used for the engine run sensor. Also, as those skilled in the art will appreciate, such an engine run sensor can be used controlling other engine testing and/or maintenance procedures based in part on the signals from such a sensor.

Figure 8:
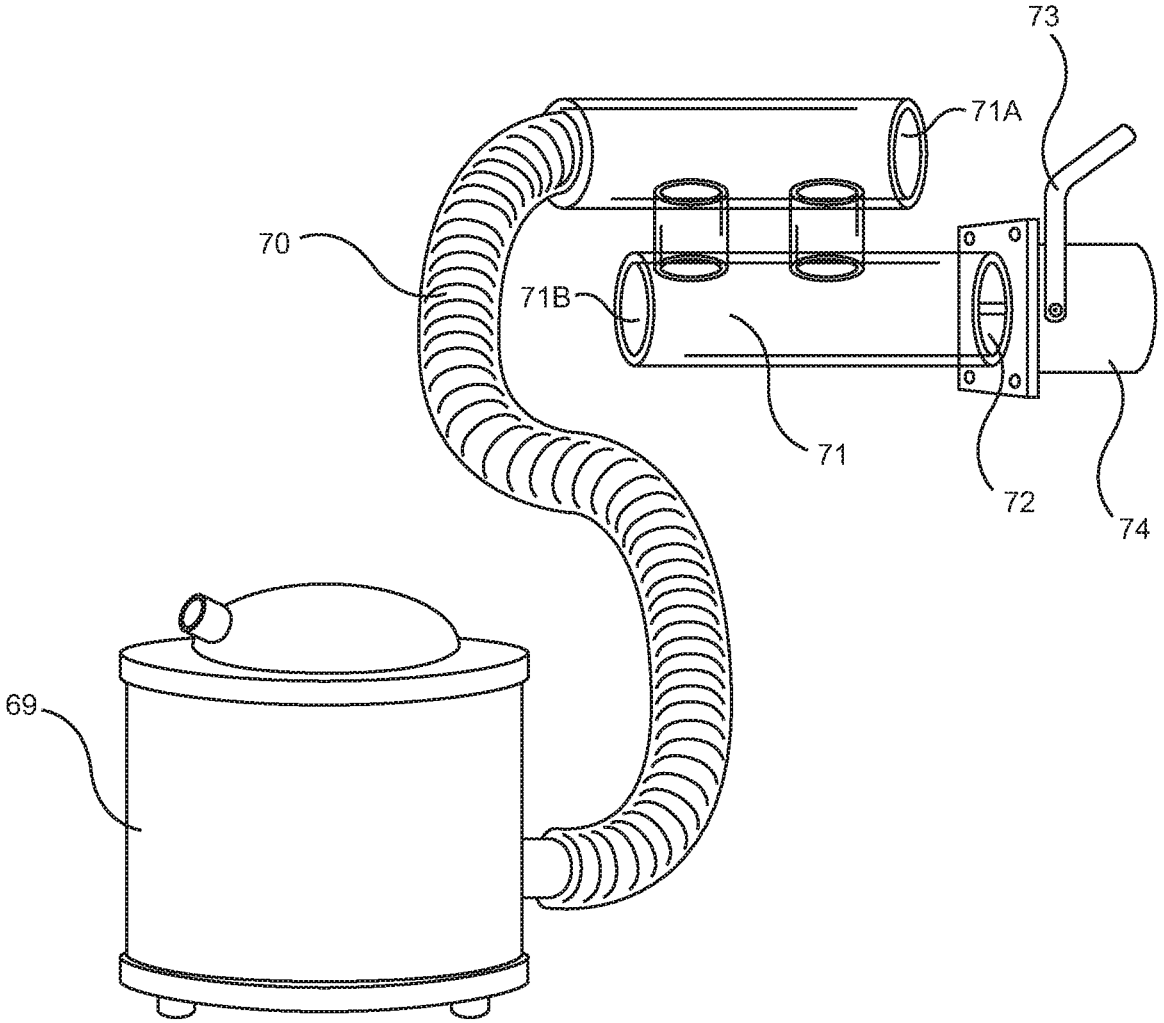
FIG. 8 illustrates the drawing of the vacuum testing apparatus of the present invention.

In order to observe the chemistry delivery from various nozzles an apparatus was built as shown in FIG. 8. An industrial 6.5 HP wet and dry vacuum 69 is connected with hose 70 to one end of a clear acrylic plastic tube set 71 that is sealed on ends 71A and 71B. A throttle body 74, with a throttle plate 72, and throttle control lever 73, from a vehicle is mounted to the other end of clear acrylic plastic tube set 71. The vacuum system 69 is turned on and the various types of nozzles (e.g. conventional oil burner nozzle, air bleed nozzle, and the novel induction cleaner nozzle disclosed herein) were tested for actual delivery. Due to the toxic nature of induction cleaning chemicals, water (being of similar viscosity to induction cleaner) was used. The droplet sizes, puddling, and the ability for the droplets to stay suspended in the moving air column were then observed.

Figure 9:
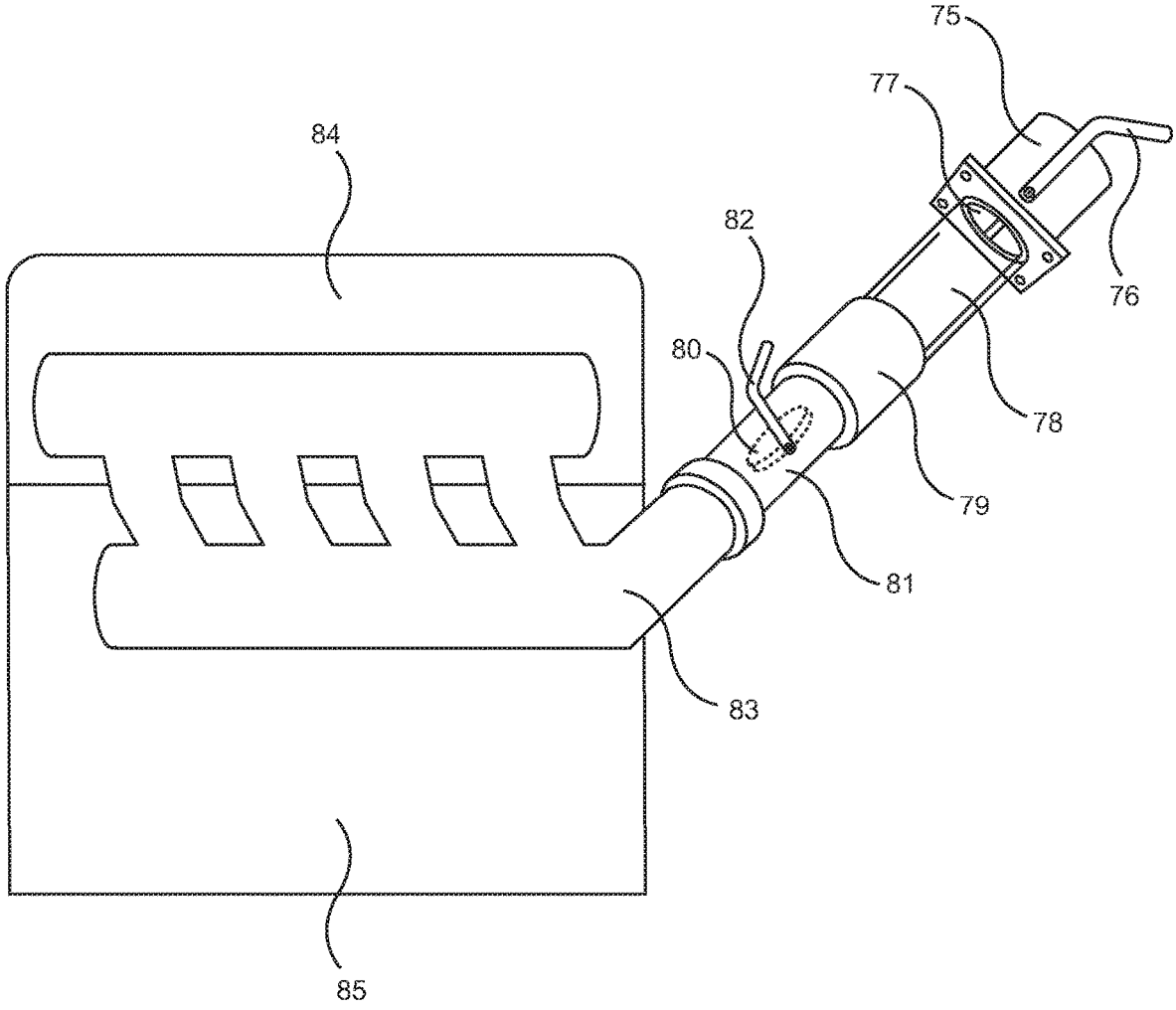
FIG. 9 illustrates the drawing of the vehicle testing apparatus of the present invention.

Once the testing was concluded with the wet and dry vacuum, an apparatus was built as seen in FIG. 9 that attached to an internal combustion engine 85. A throttle body 75 with a throttle plate 77 and throttle control 76 from a vehicle was attached to a clear acrylic plastic tube 78. The clear acrylic plastic tube 78 was connected with a rubber hose 79 to the vehicle's throttle body 81. The throttle plate 80 in throttle body 81 was held at wide open throttle with throttle control 82. The air was allowed to be metered into engine 85 through the intake manifold 83 connected to head 84 with throttle body 75. The different nozzles (e.g., conventional oil burner nozzle, air bleed nozzle, unique induction cleaner nozzle) were then connected and observed for droplet size, puddling, and the amount of droplets that remain suspended in the moving air column.

Figure 10:
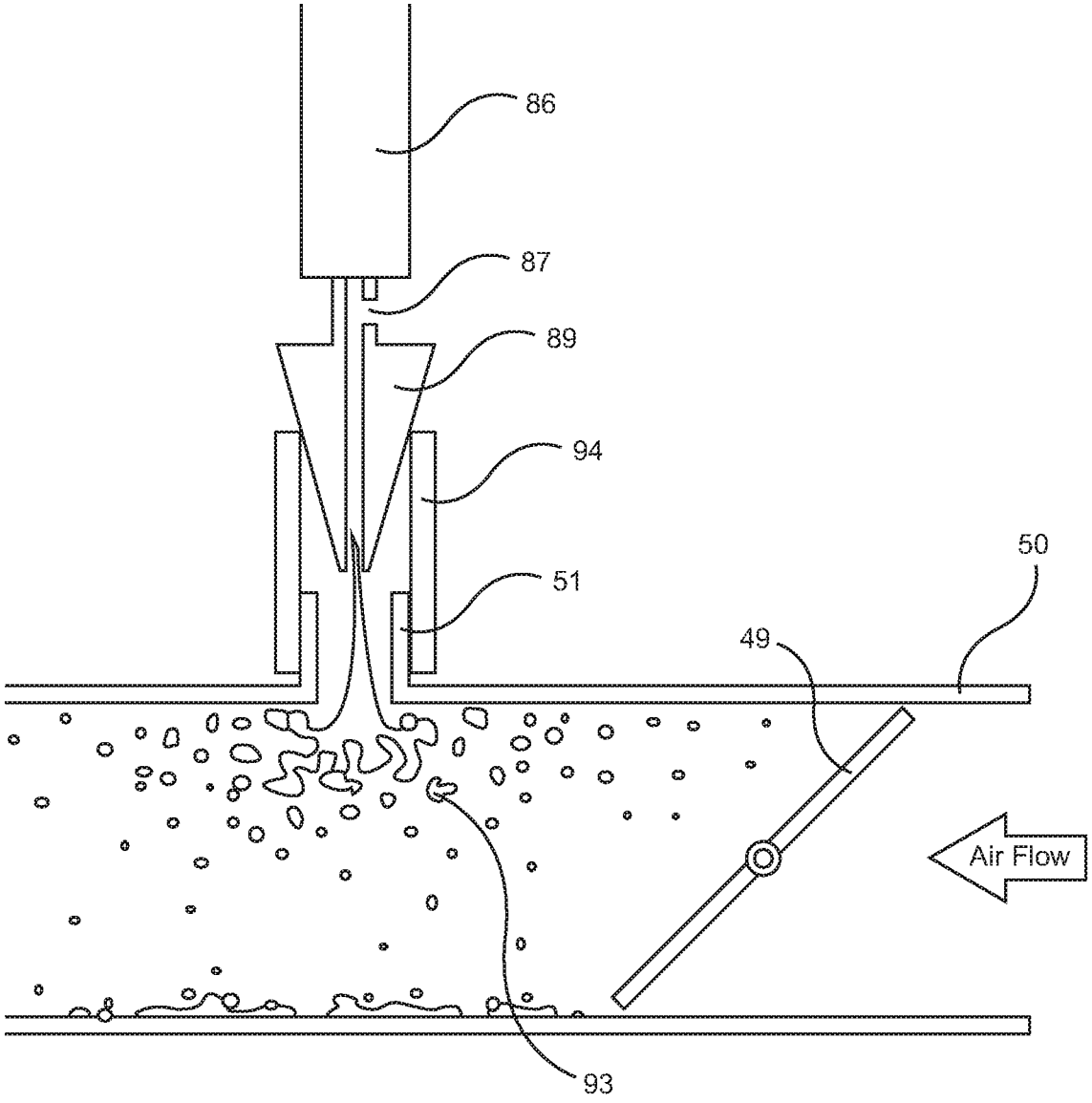
FIG. 10 illustrates the drawing of the prior art air bleed induction cleaner nozzle working.

Different prior art nozzles were tested in conjunction with the apparatus illustrated in FIGS. 1-7 and the delivery of induction cleaning chemistries in timed intervals as disclosed herein. FIG. 10 illustrates the use of an air bleed nozzle, such as disclosed in FIG. 4B in U.S. Pat. No. 6,530,392 B2 issued to Blatter. This nozzle works by using the low pressure of the engine to pull the chemistry from a reservoir (not shown) through the engine vacuum port 51 into the induction system. As the chemistry is pulled from the reservoir through delivery tube 86 air is bled through hole 87 and is mixed with the chemistry in discharge nozzle 89 connected with vacuum hose 94 to vacuum (or intake) port 51. This delivery system makes a very uneven spattering 93 of the chemistry as it is discharged into the intake tract. This chemical spattering 93 creates large droplet sizes that tend to fall out of the air column and create puddling in the intake tract as illustrated. Wide Open Throttle (WOT) snaps, not disclosed by Blatter, will help create turbulence that will break these puddles up and carry more of the chemistry/chemistries into the engine. However, the throttle cannot be held in its wide open position for the duration of the cleaning process without causing engine damage. Notwithstanding the drawbacks of the Blatter nozzle, its use in conjunction with the staged delivery of chemistry/chemistries as disclosed herein, increased the amount of carbon removed from the induction system.

Figure 11:
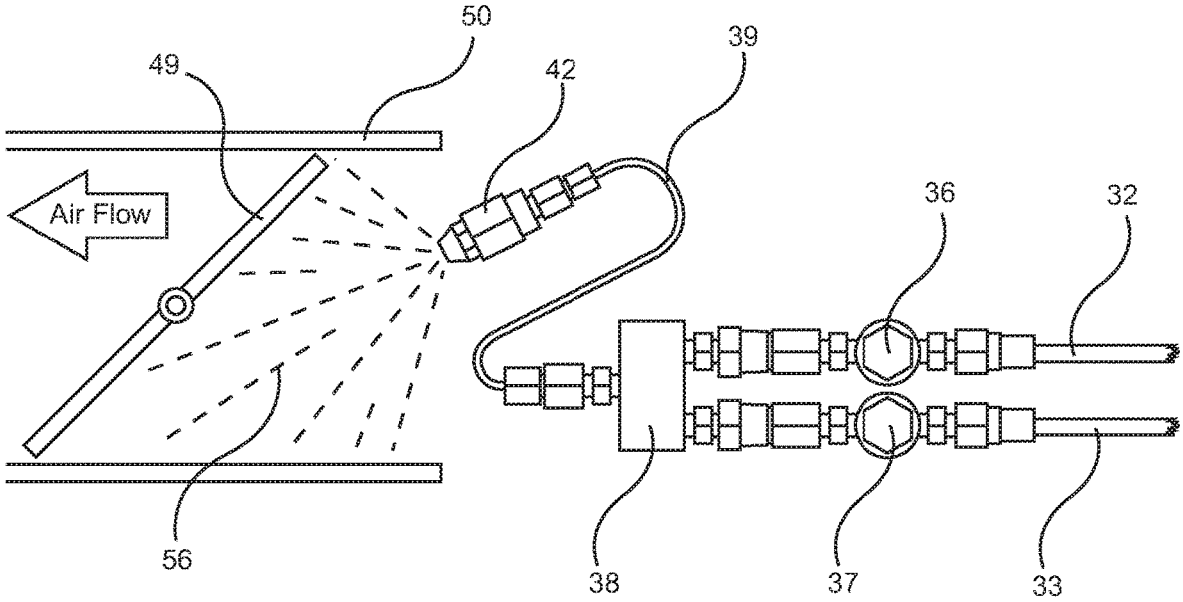
FIG. 11 illustrates the drawing of the conventional oil burner nozzle working.

FIG. 11 illustrates the use of a conventional oil burner nozzle 42 with pressurized reservoirs such as illustrated in FIG. 3 to supply the nozzle 42 with chemistries. Oil burner nozzle 42 can have many different flow rates and discharge angles. Regardless of which type of oil burner nozzle is used, the methodology of the present invention requires the nozzle position to be in front of the throttle plate 49. In this position the discharged chemicals 56 from the nozzle 42 will hit the throttle plate 49 and throttle body 50 causing the chemical to impinge on the parts. Once the discharge chemical 56 has contacted the throttle plate 49 or throttle body 50 sides, some of the small droplets created by the oil burner nozzle will run to the edge of the throttle plate 49 where they will congeal. More specifically, the droplets will move around the plate where some will slide on to the back of the throttle plate 49 and become larger in size before they move into the moving air. The air flow moving past the throttle plate edge will move some of the droplets into the engine. However, many of these congealed droplets will tend to puddle in the intake floor. WOT snaps will help create turbulence that will break these puddles up and carry the cleaner into the engine. Additionally during WOT snap events, the cleaner does not hit the throttle plate and the aerosol droplets created by the oil burner nozzle will be carried to the carbon sites. The problem here, as discussed above, is that the snap throttle event is for a very short time. When using the oil burner nozzle in an internal combustion engine without a throttle plate, such as some gasoline engines and most diesel engines, there is no throttle plate to obstruct the chemical delivery. In this situation the chemistry will stay suspended in the moving air. However the droplet sizes are so small that the chemistries tend to flash into a vapor state. (This is because oil burner nozzles are designed so that the oil would be changed from a liquid to a vapor in order for the oil to burned and produce heat in a furnace.) And, once the induction cleaning chemistry is changed from a liquid to a vapor the chemistry will not work as well. It is important to also understand that an electric injector such as, but not limited to, an automotive style injector could be used in place of the electric solenoid and oil burner nozzle. With this electric automotive style injector similar results could be obtained.

Figure 12:
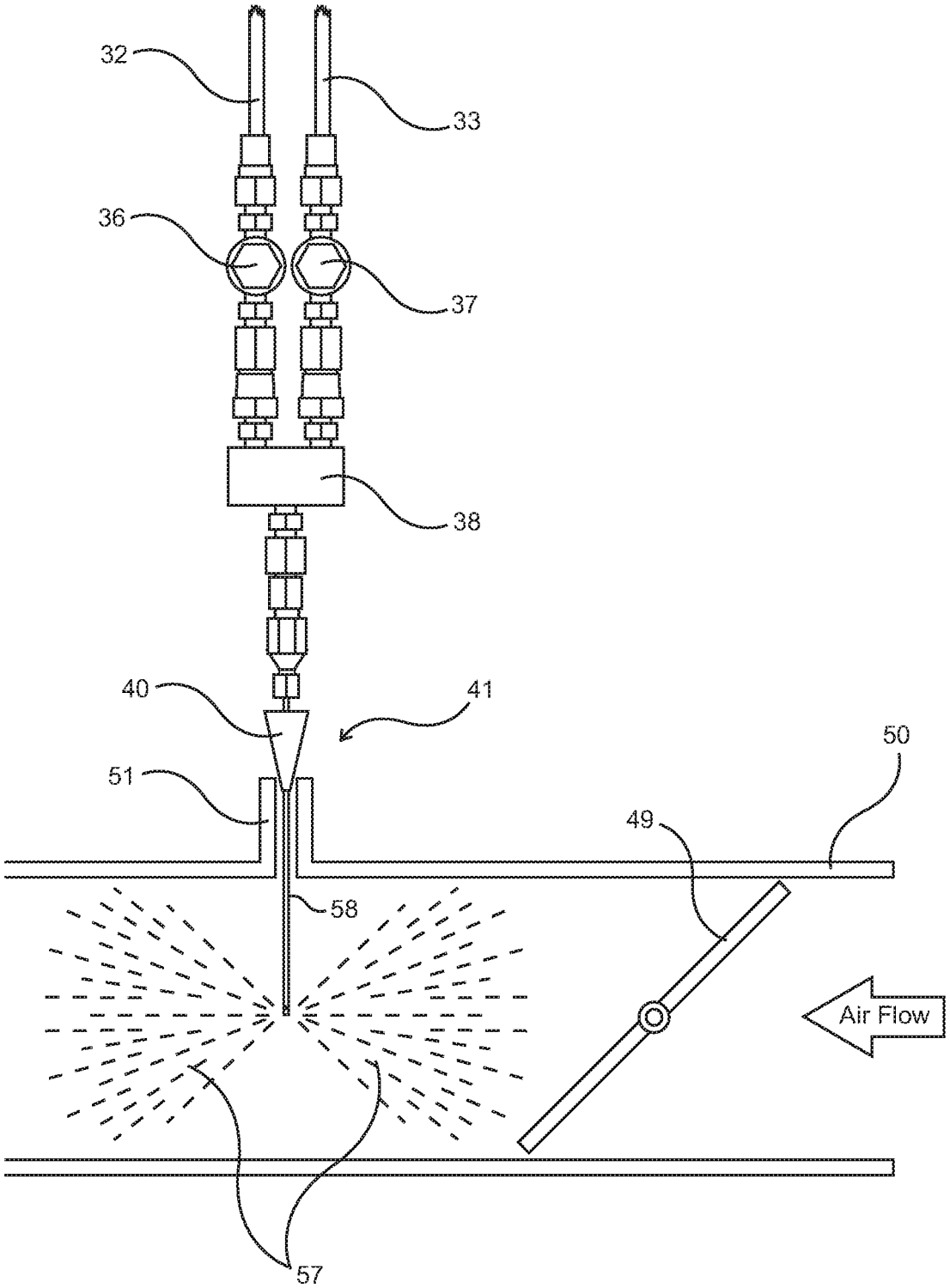
FIG. 12 illustrates the drawing of the unique induction cleaner nozzle of the present invention working.

FIG. 12 illustrates induction cleaner nozzle 41 which has been designed to overcome the limitations of prior art nozzles, such as described above. While the overlaying techniques of the present invention work with prior art nozzles (e.g., an oil burner nozzle), due to limitations such nozzles have with regard to droplet size including vaporization, chemical impingement, and puddling within the induction tract the chemistry cannot reach all of the carbon sites. And, if the chemistry does not reach the carbon, it cannot be removed. However with the unique induction cleaner nozzle 41 design parameters the droplet configuration, puddling, and chemical impingement problems are overcome. The induction cleaner nozzle 41 uses a pressurized reservoir (e.g., FIGS. 2-3) to supply nozzle 41 with chemistry. Cleaner nozzle 41 includes a tube 41A that is small enough to slip through the inside of the vacuum port 51. This will allow the chemistry to be directly delivered as small droplets (e.g., an aerosol spray) 57 into the moving air column as illustrated in FIG. 12. The preferred tube size is 0.125 of an inch which has been determined to fit through most vacuum ports on modern engines. Since the chemistry is delivered under pressure the droplet size can be controlled and maintained to a very small size. This very small droplet size allows some of the chemical to fall out of the air column without puddling with the remainder suspended within the air column to continue movement down the induction system where more of the chemistry will come into contact with more carbon sites. The chemistry droplet sizes are very important. If the droplets are too large the chemical may tend to fall out of the moving air flow through the induction system right away, thus not wetting all of the carbon sites. If these droplets are too small the chemicals may tend to vaporize, thus the carbon sites cannot be effectively wetted. In either of these scenarios the carbon may not be removed from all areas of the induction system. (Again, it is best to wet the carbon with the liquid chemistry in order to remove it.) Additionally the spray 57 does not come into direct contact with the throttle plate 49 or throttle body 50 allowing it to remain suspended within the moving air column. This allows the chemistry to reach all the carbon sites within the induction tract, thus more carbon can actually be removed than with the use of the prior art nozzles.

During development of nozzle 41 many different nozzle types were built and tested. It was found that a straight tube that is open on both ends and is inserted into air bleed nozzle 89 (air bleed nozzle is illustrated in FIG. 10) will improve chemistry delivery. With this delivery device the liquid chemistry will be discharged into the middle of the moving air column (instead of being discharged at the end of the vacuum port on the side of intake track as illustrated in FIG. 10), which allows more of the liquid droplets to remain suspended. It was also found that a straight tube that is open on the end inserted in the middle of the moving air column with an array of very small openings worked well with a vacuum pull delivery system. When the tube with very small openings was placed through the vacuum port (as illustrated in FIG. 12) the low pressure from the engine pulled the chemistry from a reservoir, which is under atmospheric air pressure, into the intake tract. As the chemistry moves from the nozzle opening into the intake tract the droplets that are produced shear into small droplets that remain suspended within the moving air column. Additionally a tube with very small openings was found to work well with a pressurized reservoir. The pressure forces liquid through the very small openings that form liquid streams, these steams break up into smaller droplets within the moving air column.

Figure 13A:
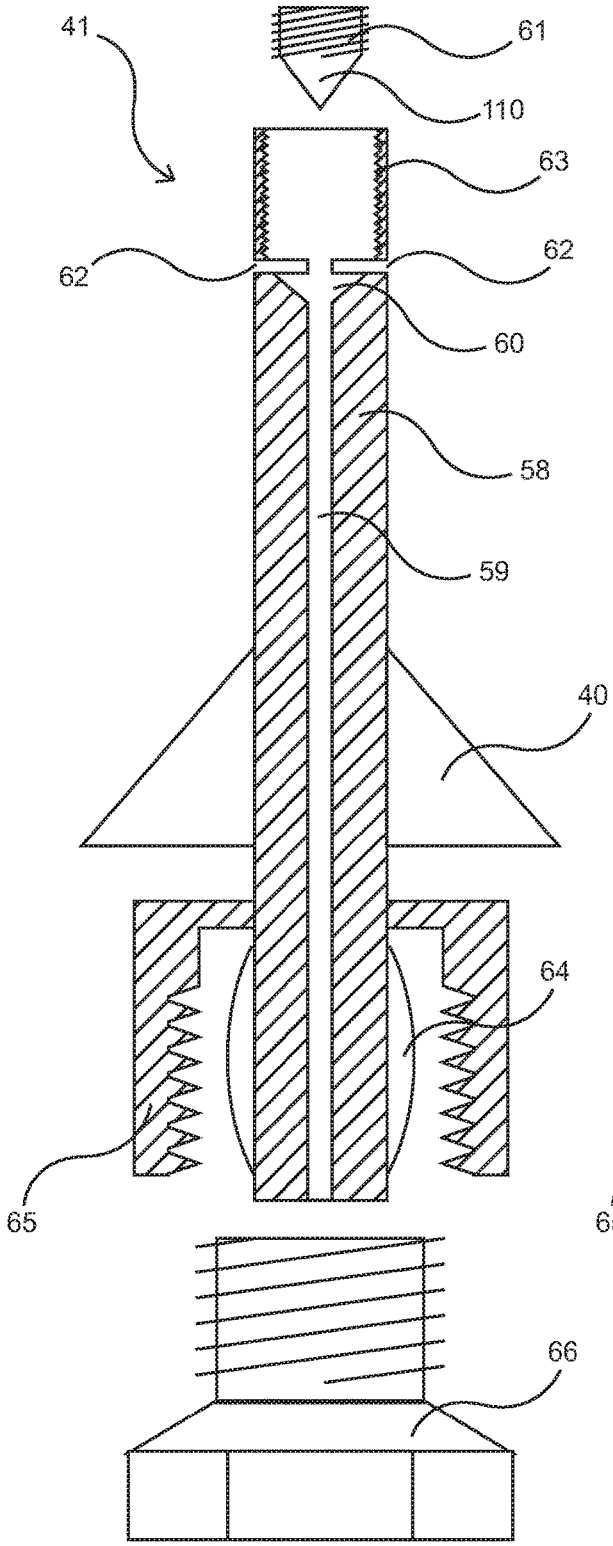
FIGS. 13A and B illustrate the cross sectional views of the induction cleaner nozzle of FIG. 12.
Figure 13B:
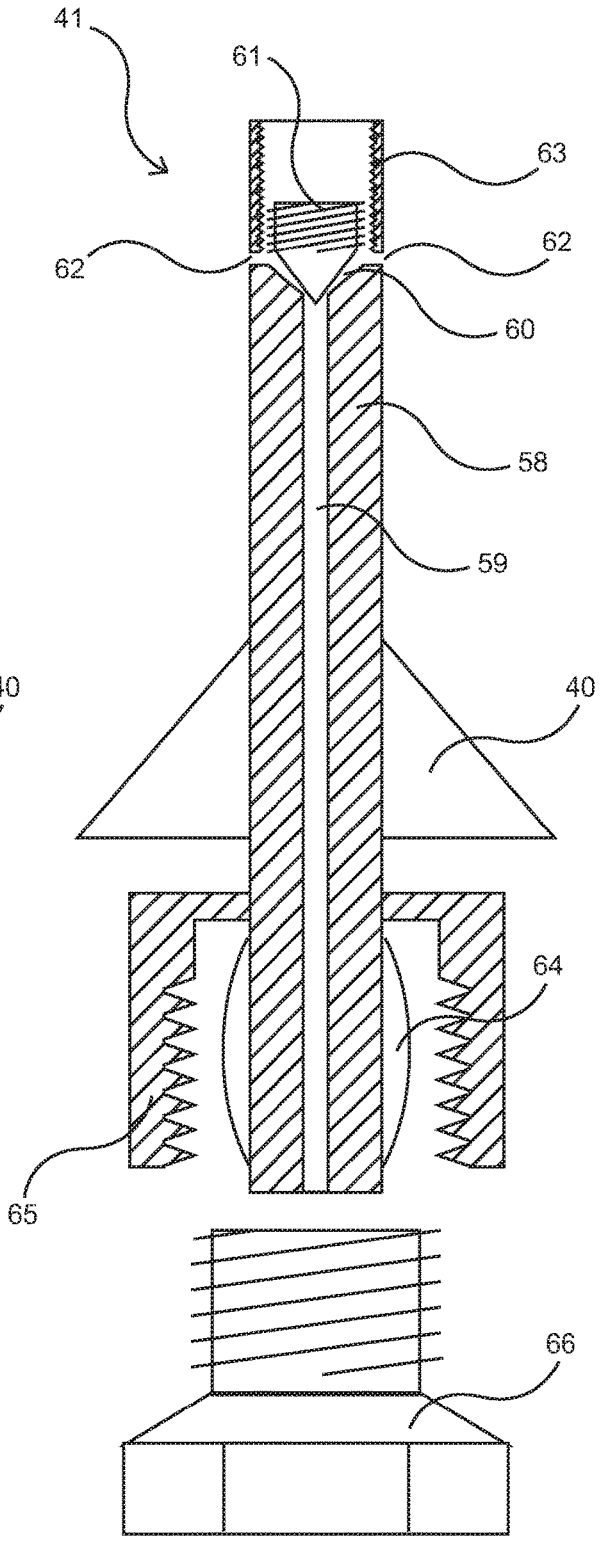

The preferred design for the induction cleaning nozzle 41 is shown in FIGS. 13A and B. In this design tube 58 is held by bushing 64 and bushing nut 65 to mounting nut 66. Mounting nut 66 also has a porous brass filter in it (not shown) to filter impurities from the induction cleaning chemicals being used. Tapered vacuum seal 40 slides on tube 58 in order to seal tube 58 to the vacuum port on engine. This also allows the depth of tube 58 to be adjusted into intake tract. Tube 58 has passage 59 that delivers induction cleaning chemistry to openings or slots 62. As the chemistry is moved through passage 59 it comes in contact with the cone shaped surface 110 of tapered screw 61 (discussed in greater detail in conjunction with the discussion of FIGS. 16A-J). Tapered screw 61 fits into angled outlet 60 which is a seat for surface 110. This fit between surface 110 and angled outlet 60 sets up a restriction that the pressurized liquid pushes against. The threads 63 allow tapered screw 61 to be adjusted into angled outlet, thus setting up the desired restriction. As the liquid moves through this restriction the pressure drops and the liquid is forced through slots 62. There are two slots placed on tube 58, one on each side.

Figure 14A:
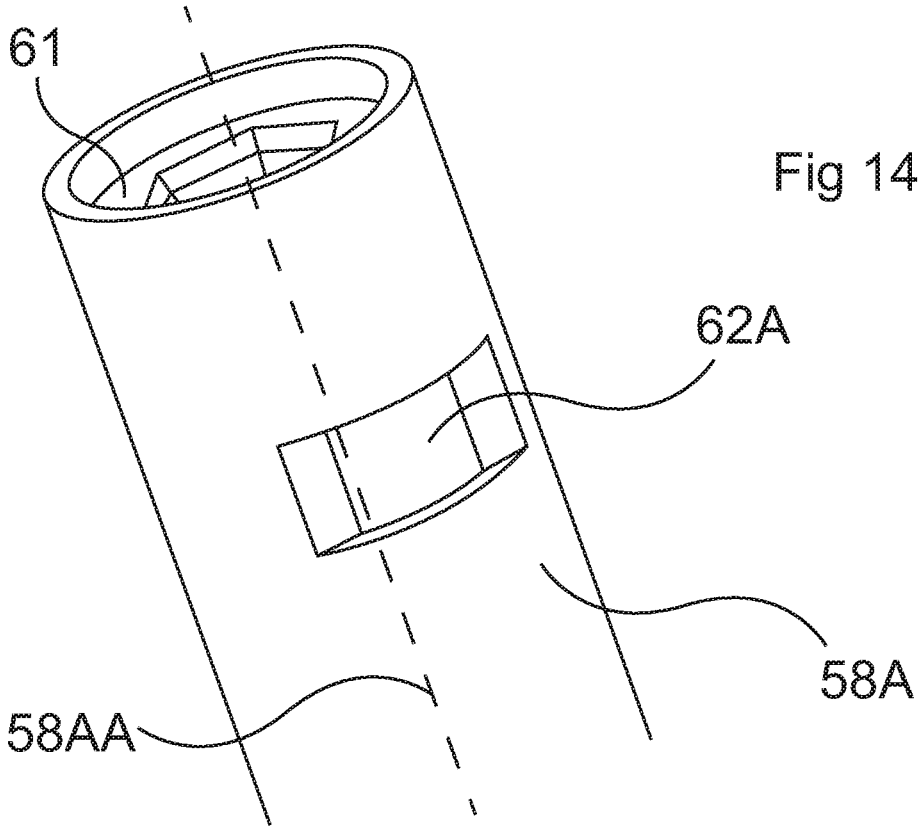
FIGS. 14A and B illustrate alternate slot designs for the nozzle of FIG. 12.
Figure 14B:
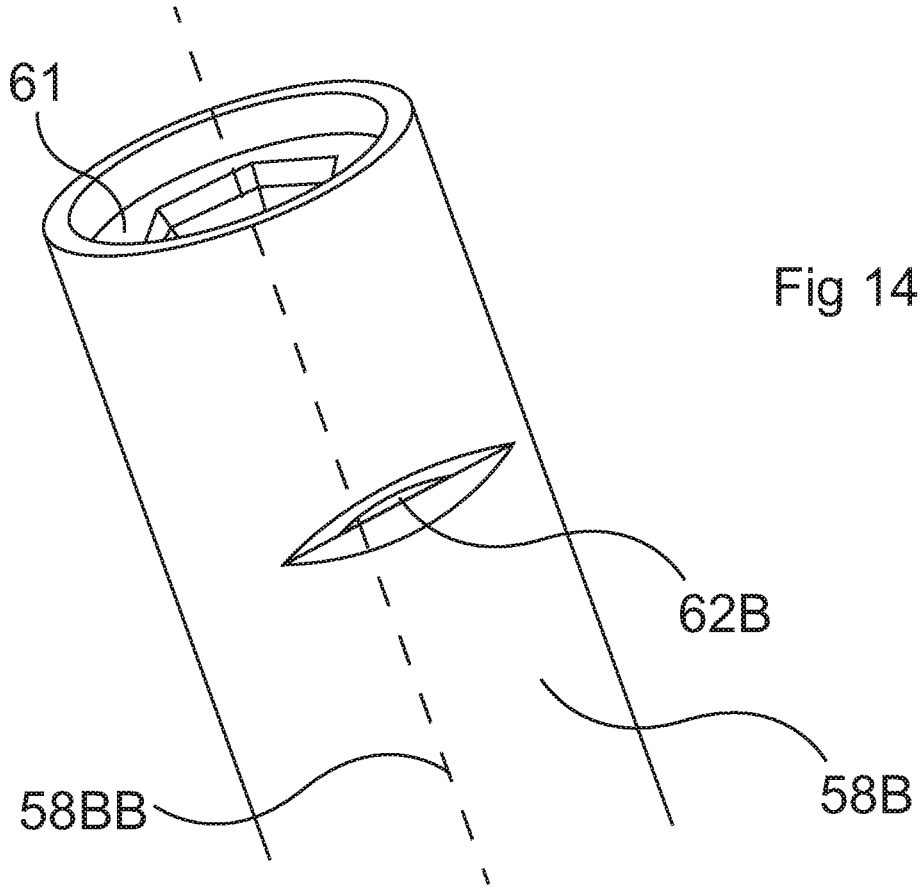
Figure 15A:
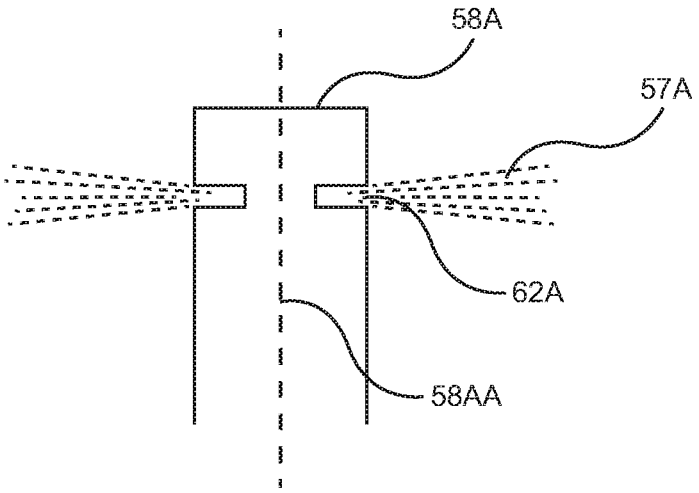
FIGS. 15A, B, and C illustrate the spray pattern from different slot designs.
Figure 15B:
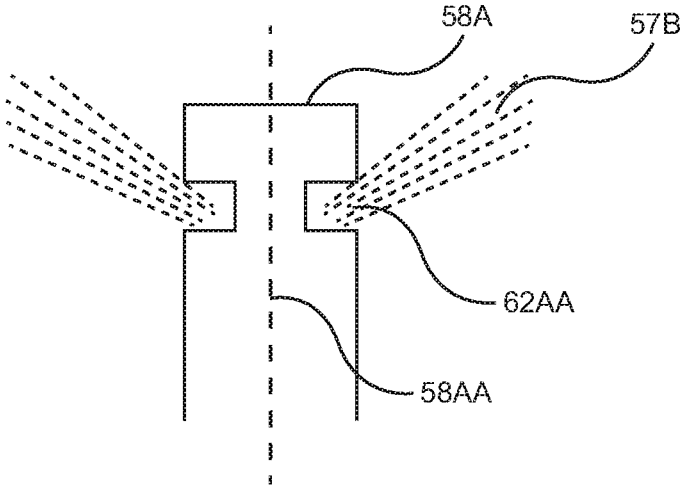
Figure 15C:
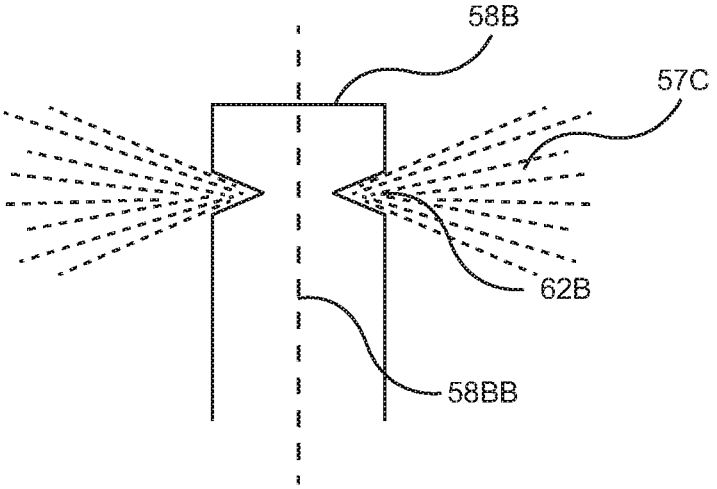

In FIGS. 14A and B, 15A, B and C, 16A-J, 17 and 18A and B several different discharge orifice (i.e., slot) and tapered screw designs are shown. With reference to FIGS. 14A and B, slot 62A shows a rectangular opening in tube 58A (including a longitudinal axis 58AA) that has tapered screw 61 at end of tube 58A. Slot 62B shows a fish mouth opening in tube 58B that also has tapered screw 61 at end of tube 58B. By changing this discharge orifice design the shape and direction of the chemical discharge from nozzle 41 is also changed. The discharge slot width can be made smaller or larger which will also change the liquid discharge from nozzle 41. In FIGS. 15A, B and C several different spray patterns are demonstrated from several different slot designs. In FIG. 15A the narrow slot 62A is used, with this design the spray pattern 57A projects from tube 58A with a trajectory generally perpendicular to axis 58AA. In FIG. 15B a wider slot 62AA is used, which results in the spray pattern 57B projecting from tube 58B with an angled trajectory. In the slot design and associated testing, the size of the slot (e.g., slot 62A) in the dimension parallel to the longitudinal axis of the tube has ranged from 0.040 to 0.006 inches. In FIG. 15C the fish mouth slot 62B is used With this design the spray pattern 57C projects from tube 58B with a perpendicular trajectory that has a wider angle than that obtained from the use of slot 62A.

Figure 16A:
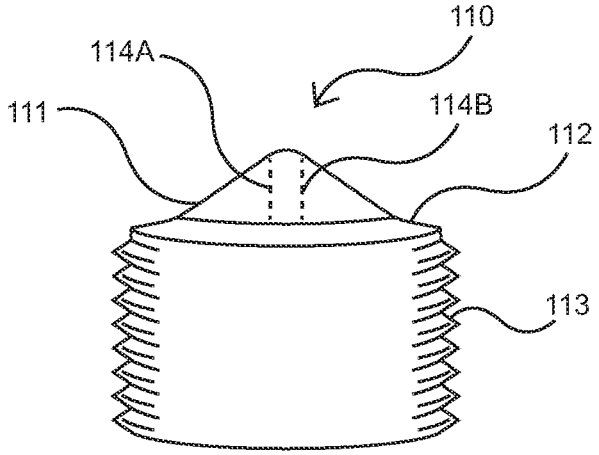
FIGS. 16A-J illustrate, side and top views, the different line designs on the tapered screw cone of the nozzle of FIG. 12.
Figure 16B:
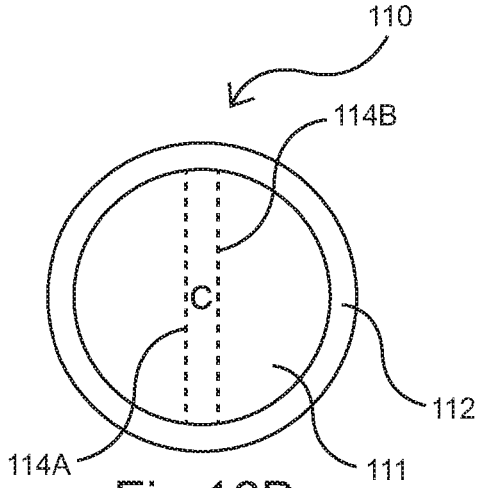
Figure 16C:
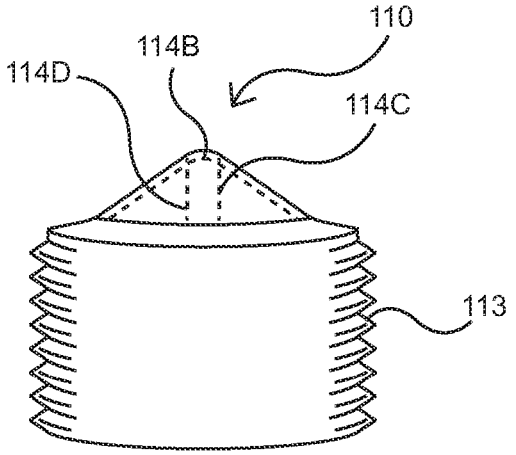
Figure 16D:
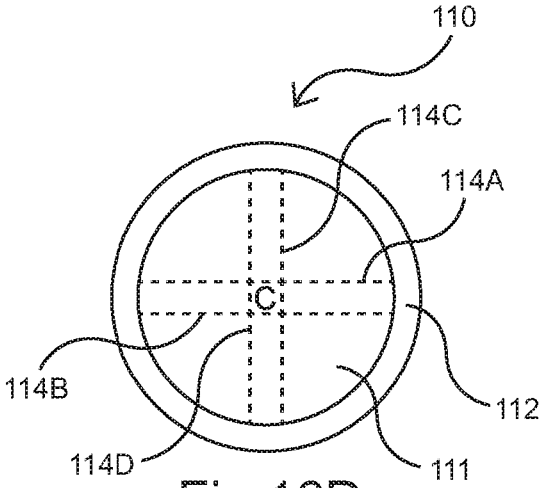
Figure 16E:
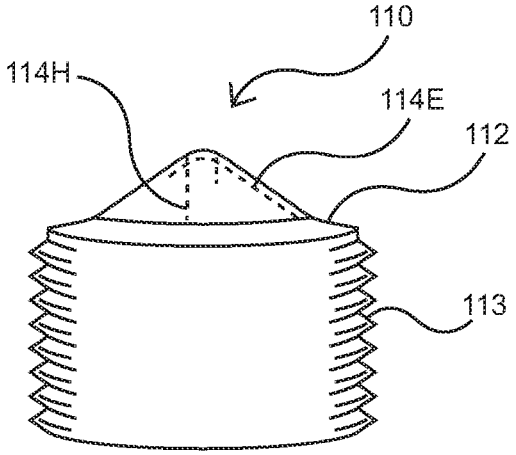
Figure 16F:
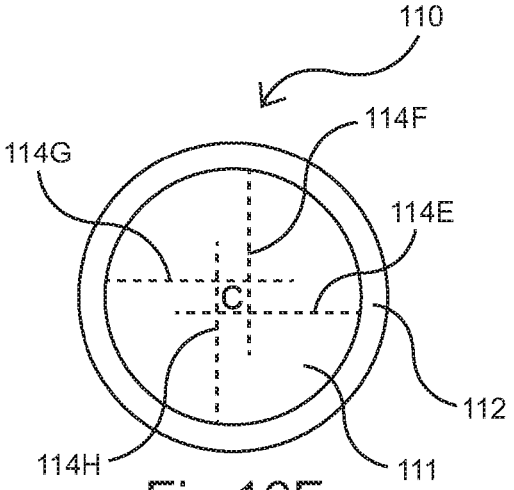
Figure 16G:
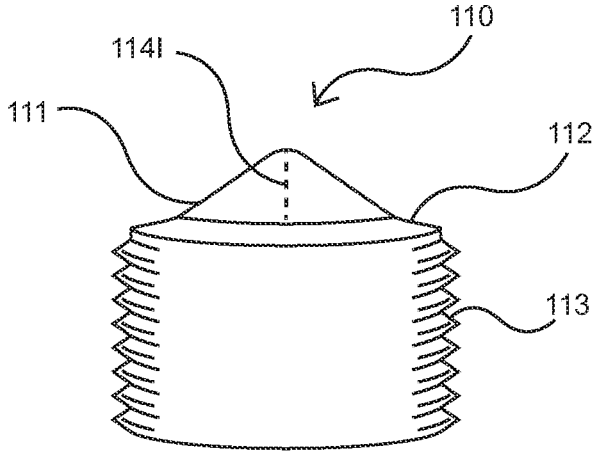
Figure 16H:
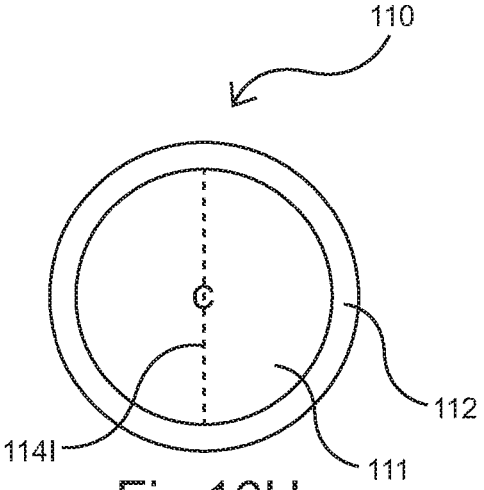
Figure 16I:
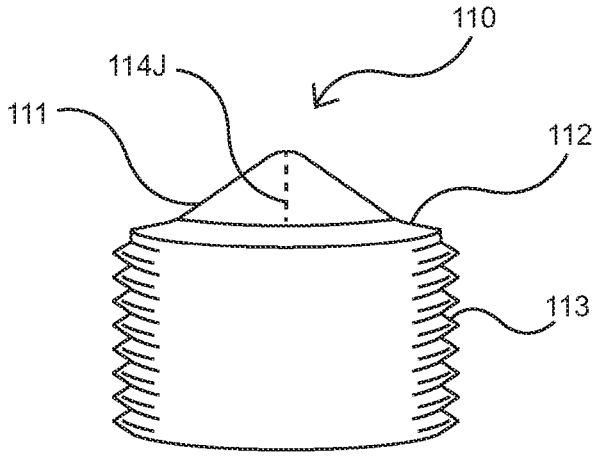
Figure 16J:
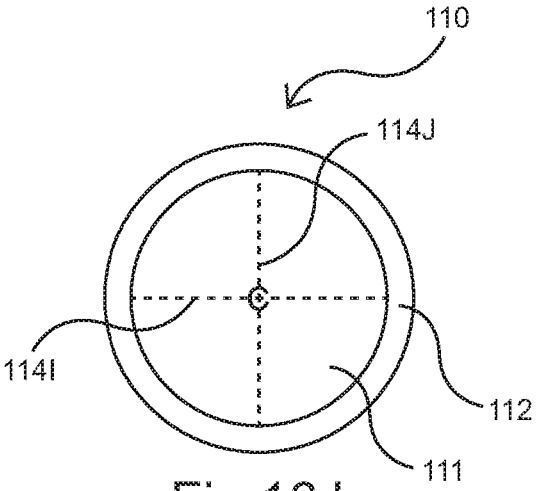

In FIGS. 16A-J several different tapered screw designs are shown. The illustrated engraved line designs (e.g., 114A and 114B) will change the discharge droplets configuration With reference to all 6 figures, surface 110 includes a cone shaped portion 111 surrounded by a donut shaped shoulder 112. Threads 113 are designed to engage with threads 63 shown in FIGS. 13A and B. FIG. 16A shows a side view of the tapered screw where lines 114A and B are engraved across the face of cone 111. FIG. 16B shows an overhead view of the tapered screw. FIGS. 16C and D show the top and side view of the tapered screw where surface 110 has 4 lines (114A, 114B, 114C and 114C) are engraved across the face of the cone shaped portion 111. FIGS. 16E and F show a side and top view of the tapered screw where 4 lines (114E, 114F, 114G and 114H) are engraved across the face of the cone shaped portion 111. FIGS. 16G and H show the side and top view of the tapered screw where groove 114I is engraved across the face of the cone. FIGS. 16I an J show an overhead and side view of the tapered screw where lines 114I and J are engraved across the tapered cone. With each line design the droplets are slightly changed as they emerge from the slot(s) (e.g., slots 62 in FIGS. 13A and B, and slots 62A in FIG. 15A). Additionally these lines, channels or grooves can be produced with a laser or can be machined on to the tapered screw cone. However when the lines are made with an engraver the line surface is rough and uneven which helps the liquid breakup and form droplets.

Figure 17:
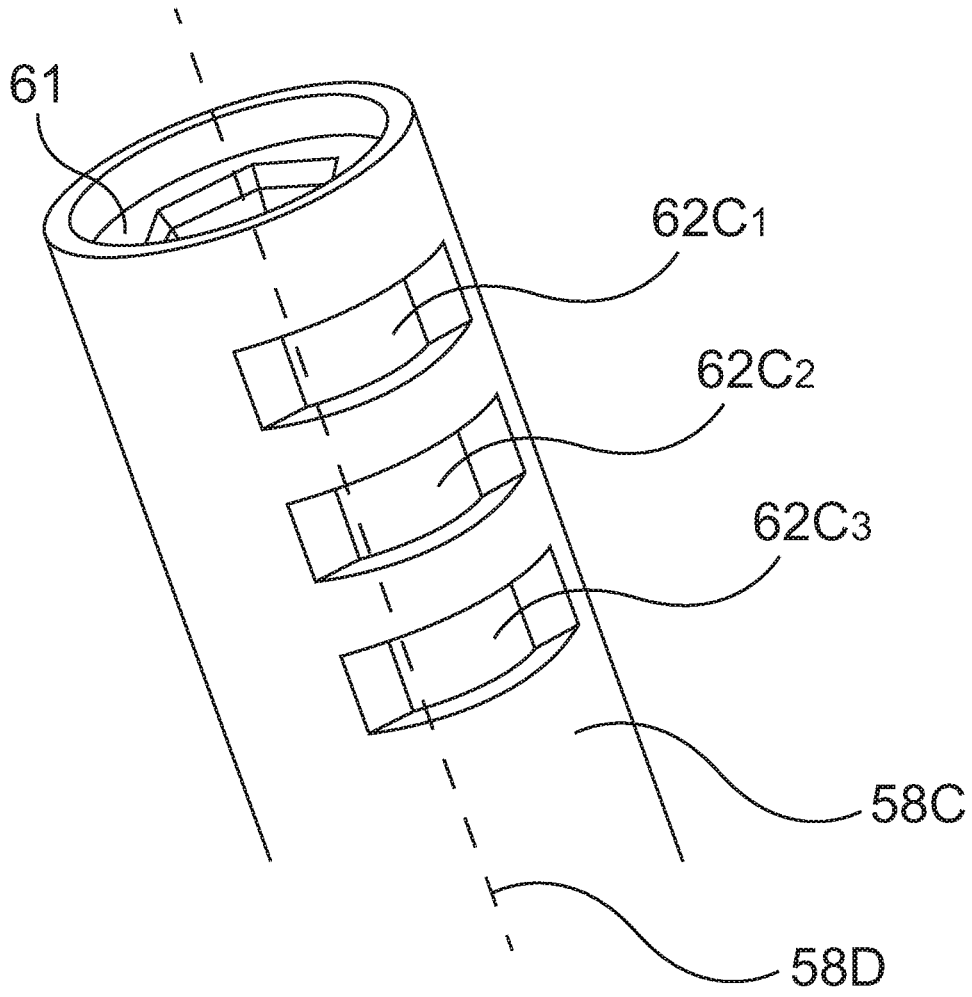
FIG. 17 illustrates the nozzle of FIG. 12 with a vertical arrangement of slots.
Figure 18A:
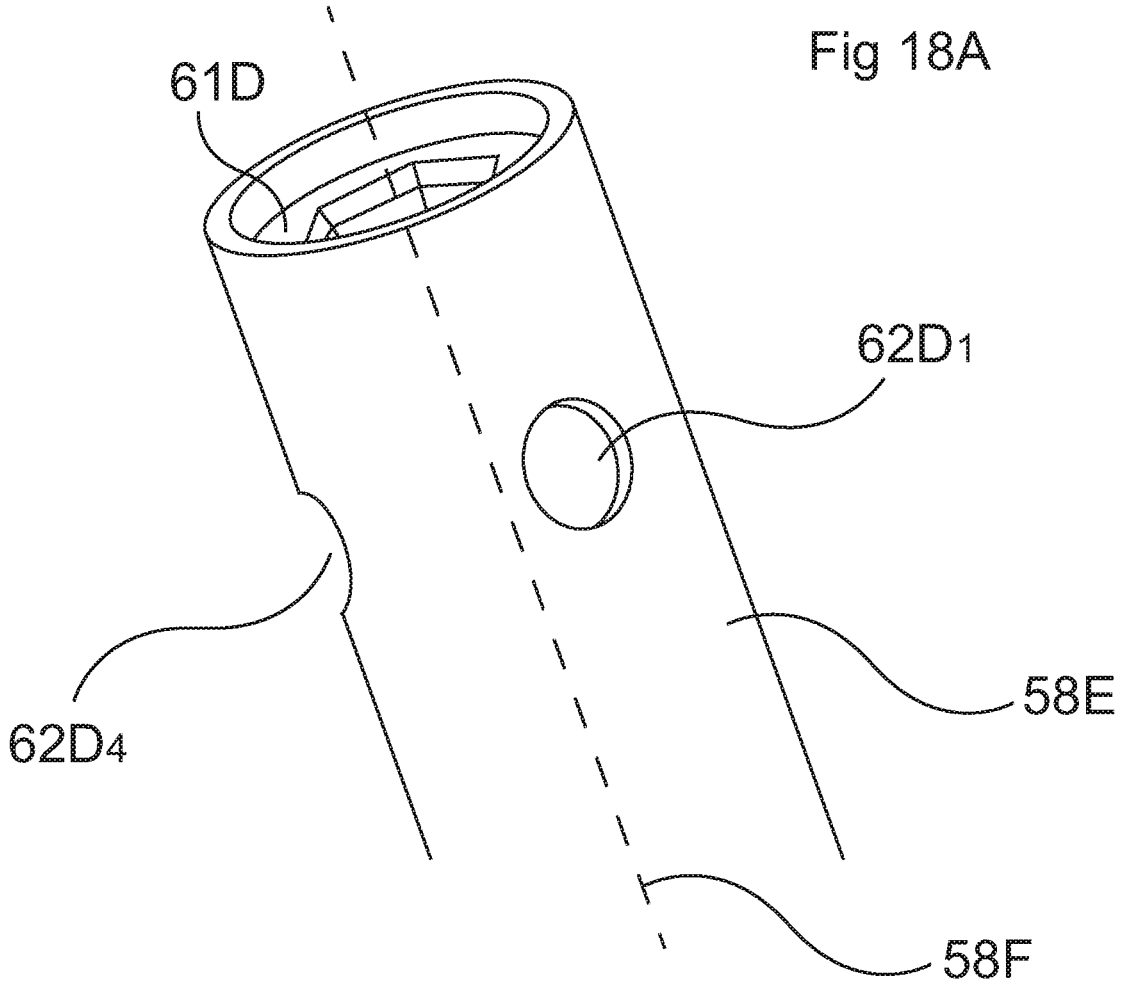
FIGS. 18A and B illustrate the nozzle of FIG. 12 with a series of slots in a plane perpendicular to the longitudinal axis of the nozzle.
Figure 18B:
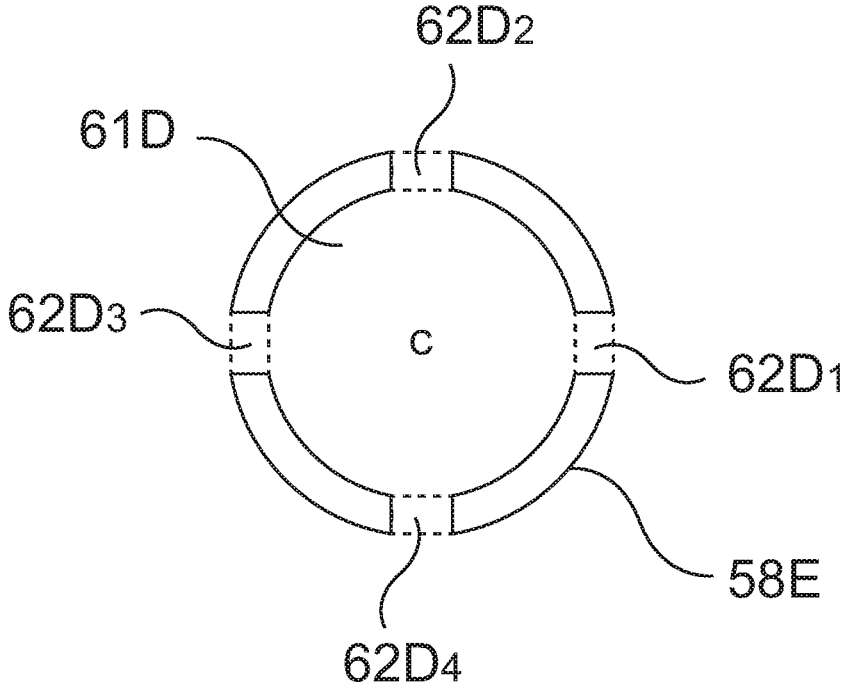

With reference to FIG. 17, tube 58C has a series of slots 62C1, C2 and C3 which are aligned vertically and substantially parallel to longitudinal axis 58D. This style slot design would be used with a vacuum pull system. With reference to FIGS. 18A and B, tube 58E has a series of slots or holes 62D1, D2, D3 and D4 which lie in a plane which is substantially perpendicular to axis 58F. As tapered screw 61D threads into tube 58F it comes close to seat on interior tube seat 60 (see FIG. 13B). The four slots or holes 62D1, D2, D3 and D4 are machined through the wall of tube 58E to the interior tubing channel right above the taper screw seat. Again, see FIG. 13B. With this arrangement, the chemical has an even disbursement all the way around the nozzle tube assembly. Further, with reference to arrangement of slots as shown in FIGS. 18A and B, there is no preferred rotational position of tube 58E about its longitudinal axis when positioned in the induction system. The initial orientation of the chemistry as it exits the slots will be in a plane substantially perpendicular to axis 58F and have a spray pattern such as illustrated in FIG. 12. The tapered screw orifice restriction and the gas pressure will determine the overall flow rate of the chemistry through the nozzle.

Thus, those skilled in the art will appreciate the design details of nozzle 41 can be varied to maximize the ability to delivery chemistry to all interior surfaces of the induction system. They should appreciate that size of the droplets and the spray pattern are affected by factors such as the particular chemistry used (and its associated viscosity and flash point), the chemistry delivery pressure, the size, shape and number of slots, the shape of surface 111, the configuration of engraved lines 114, and the manner in which the lines are produced. With the use of these design parameters for nozzle 41 many advantages can be observed. Since the induction cleaning chemistry can be delivered to the carbon sites throughout the induction system the carbon removal from all such sites can be accomplished. Additionally, no induction or air filter boots will need to be removed. If a MAF sensor is used it will still be intact and be able to send air weight data to the ECU. Since the engine and sensors are all intact the engine will run normally during induction cleaning without setting any Diagnostic Trouble Codes (DTC). This will allow the throttle and RPM to be changed during induction cleaning. With the throttle opened or during snap throttle events the air column flowing into the engine has greater energy which allows the selected induction cleaning chemistry to have more force when impacting the carbon sites, thus having a greater cleaning impact. Another advantage is the nozzle will work in gasoline based engines or diesel based engines as both style engines have an induction system with an opening or port into the intake system. Yet another advantage is that the throttle plate and throttle body on gasoline based engines are not cleaned. If the throttle body around the throttle plate is cleaned the air flow rate around the plate is changed as well. If one is using a pressurized cleaning system and injecting the cleaner across the throttle plate, it will be necessary to have enhanced scan tools that can reset DTC's and relearn idle control functions. (Some manufactures such as Nissan will need the idle air rate relearned when you have finished cleaning the induction system.) If the throttle plate and bore need to be cleaned this can easily be accomplished by using an aerosol can with throttle body cleaner. This allows the service person to decide whether or not to clean the throttle body.

Figure 19:
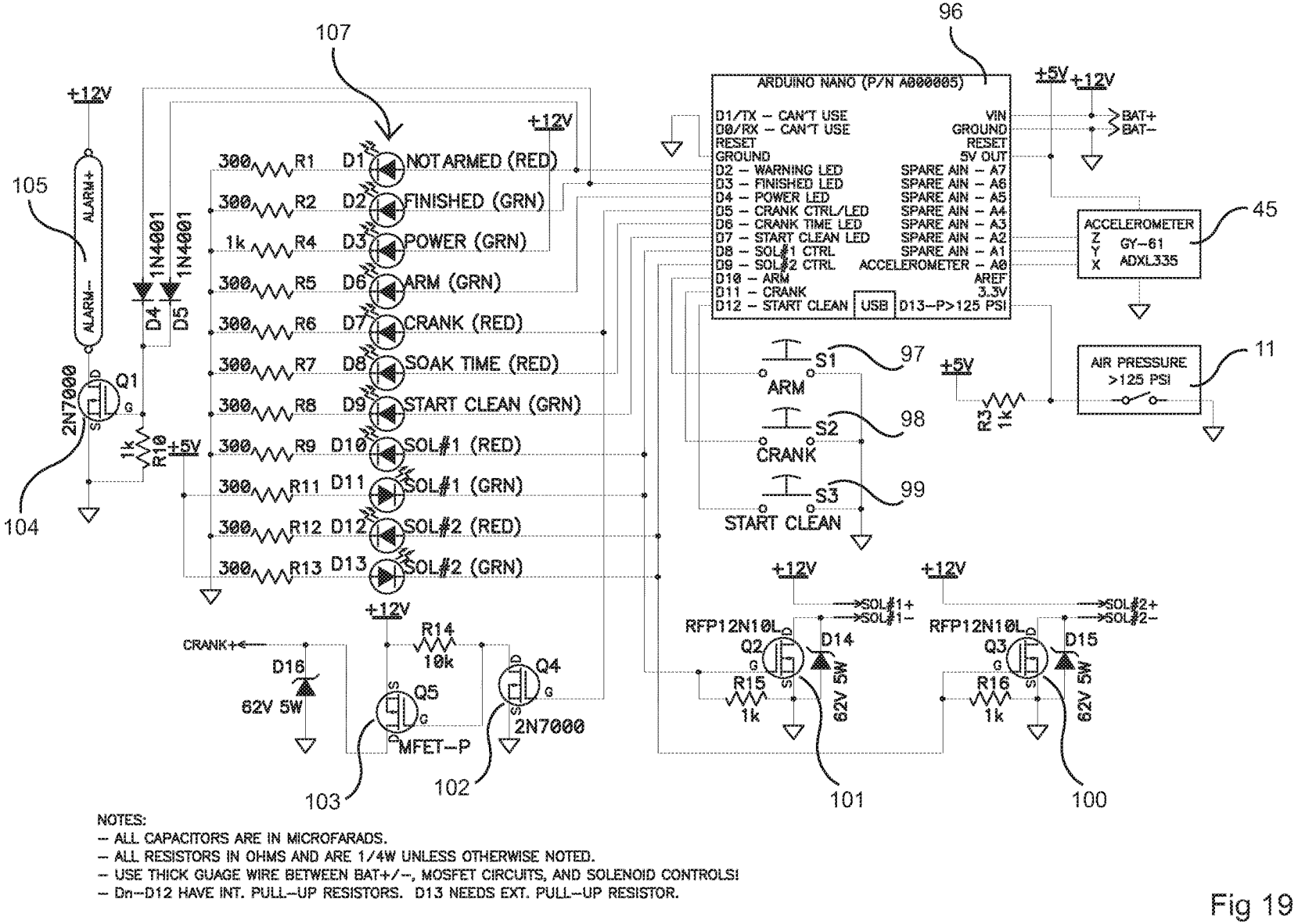
FIG. 19 is a drawing of the induction cleaner's electronic control circuit.

In FIG. 19 the preferred electronic control circuit for the Dual Solenoid Induction Cleaner is shown. The microprocessor 96 controls the Dual Solenoid Induction Cleaner. The engine run sensor 45 sends vibration signal to microprocessor 96 where this signal is processed for enabling criteria. The air pressure sensor switch 11 sends signal to microprocessor 96 where this signal is also processed for enabling criteria. Control switches 97, 98, and 99 are used by the service person to send signals to microprocessor 96 that control the Dual Solenoid Induction Cleaner. Drivers 100 and 101 are used to turn solenoids 36 and 37 on and off. Drivers 102 and 103 are used to control starter solenoid circuit. Driver 104 is used to control audio alert 105 to alert service person to different conditions of the Dual Solenoid Induction Cleaner. Lamp circuits 107 are controlled by microprocessor 96 to alert service person to different conditions of the Dual Solenoid Induction Cleaner.

In order for microprocessor 96 to control the hardware a program for the operation of the Dual Solenoid Induction Cleaner was created. The preferred embodiment is shown in FIG. 20. The program takes into account the various operating conditions of the device, including the run profiles stored in microprocessor 96, as well as the service person interaction with the device. This program not only sets up the operation of the device but also accounts for the safety of the system, the vehicle, and the service person. This is accomplished with three safety systems; the air pressure, the engine running sensor and the battery voltage. These three safeties will only allow the chemistry to be delivered under the correct conditions. This will protect the service person from chemical discharge which, if it occurs at the wrong time, could get injected on the service person or the vehicles paint. It will prevent the system from discharging chemistry into the induction with the engine off which could hydrolock the engine causing severe damage to it. Additionally it will protect the vehicle and the vehicle's microprocessors from low battery voltages. Which can cause DTC's to be set in the vehicles computer system or damage to the electronics from low battery voltage. The program also accounts for the visual and audio alerts that will be conveyed to the service person.

It is important to understand that anyone skilled in the art could alter the above described instrumentation and controls in many ways including, but not limited to, using basic electronics instead of a microprocessor to accomplish these same results. The Dual Solenoid Induction Cleaner could be designed to function with just specific chemistries supplied by a particular manufacturer/distributor. In such a situation a microprocessor with different run profiles for the various available chemistries from competing entities would not be necessary. Control of, for instance, the solenoids could be controlled by basic electronics.

Whereas the drawing and accompanying description have shown and described the preferred embodiments of the present invention, it should be apparent to those skilled in the art that various changes may be made in the forms and uses of the inventions without affecting the scope thereof.

We claim:

1. In a method of removing carbon build up from an internal combustion engine; the engine including an induction system, combustion chambers, and exhaust system; the method including using the air flow inherent in the induction system while the engine is running; the method including means for delivering two chemical compositions of matter, each having a different formulation, into the induction system;

the method including:

while the engine is running applying a layer of the first chemical composition of matter to the induction system for a first period of time, wherein the layer of the first chemical composition of matter constitutes a first layer, and wherein the first time period constitutes a first stage, whereby the first chemical composition of matter will remove a portion of the carbon build up based on its formulation;

while the engine is still running applying a layer of the second chemical composition of matter to the induction system for a second period of time, wherein the layer of the second chemical composition of matter constitutes a second layer, and wherein the second period of time constitutes a second stage, whereby during the second stage the second composition of matter will remove a different portion of the carbon build up based on its formulation, wherein the first stage and the second stage constitute a cycle; and while the engine is still running repeating the cycle at least once.

2. The method as set forth in claim 1, further including repeating the cycle for either a predetermined period of time or a predetermined number of cycles.

3. The method as set forth in claim 2, wherein both the predetermined period of time for repeating the cycle and the predetermined number of cycles is based, at least in part, on the formulation for each of the first and second chemical compositions of matter used during each of the first and second periods of time and a flow rate for each of the first and second chemical compositions of matter into the induction system during the first and second periods of time.

4. The method as set forth in claim 1, wherein the means for delivering the first and second chemical compositions of matter includes a control system to start and stop chemistry flow to the induction system, and wherein applying the first and second chemical compositions of matter includes using the control system to start and stop the flow of each of the first and second chemical compositions of matter into the induction system.

5. The method as set forth in claim 4, wherein the first chemical composition of matter has a first profile, wherein the second chemical composition of matter has a second profile, and wherein the control system includes electronics; the electronics including means for storing the first profile and the second profile; the electronics also including a routine for determining the time period for the application of the first layer based on the first profile and the time period for the application of the second layer based on the second profile; the method further including:

selecting the first profile;

selecting the second profile;

automatically selecting the period of time for the application of the first layer;

automatically selecting the period of time for the application of the second layer;

automatically applying the first layer and the second layer; and automatically repeating the cycle.

6. The method as set forth in claim 5, wherein the electronics also includes a routine for determining the number of times the cycle is to be repeated, and further including automatically repeating the cycle for a determined number of times.

7. The method as set forth in claim 5, wherein the time period for the application of at least one of the first and second layers can be varied as the cycle is repeated, and further including the step of varying the time period for the application of the at least one of the first and second layers in a cycle following the first cycle.

8. The method as set forth in claim 1, further including a third chemical composition of matter having a formulation different from both the first chemical composition of matter and the second chemical composition of matter; the method further including:

using the means for delivering the first and second chemical compositions of matter to also deliver the third chemical composition of matter;

while the engine is still running applying a layer of the third chemical composition of matter to the induction system for a third period of time, wherein the layer of the third chemical composition of matter constitutes a third layer, and wherein the third period of time constitutes a third stage, whereby during the stage the third chemical composition of matter will remove a portion of the carbon deposit based on its formulation, and wherein the first stage, the second stage and the third stage constitute a three stage cycle; and while the engine is still running repeating the three stage cycle.

* * * * *